US010704540B2

(12) United States Patent
Calomeris

(10) Patent No.: US 10,704,540 B2
(45) Date of Patent: Jul. 7, 2020

(54) ULTRASHORT PULSE LASER-DRIVEN SHOCK WAVE GAS COMPRESSOR

(71) Applicant: Anthony Calomeris, Silver Spring, MD (US)

(72) Inventor: Anthony Calomeris, Silver Spring, MD (US)

( * ) Notice: Subject to any disclaimer, the term of this patent is extended or adjusted under 35 U.S.C. 154(b) by 490 days.

(21) Appl. No.: 15/499,837

(22) Filed: Apr. 27, 2017

(65) Prior Publication Data

US 2017/0314541 A1 Nov. 2, 2017

Related U.S. Application Data

(60) Provisional application No. 62/328,135, filed on Apr. 27, 2016, provisional application No. 62/328,137, filed on Apr. 27, 2016, provisional application No. 62/328,141, filed on Apr. 27, 2016, provisional application No. 62/328,147, filed on Apr. 27, 2016, provisional application No. 62/328,151, filed on Apr. 27, 2016, provisional application No. 62/491,104, filed on Apr. 27, 2017.

(51) Int. Cl.
*F04B 19/24* (2006.01)
*F04F 7/00* (2006.01)
*F04B 53/10* (2006.01)

(52) U.S. Cl.
CPC ..... *F04B 19/24* (2013.01); *F04B 53/10* (2013.01); *F04F 7/00* (2013.01)

(58) Field of Classification Search
CPC ... F04B 19/24; F04B 53/10; F04F 1/04; F04F 1/16; F04F 7/00
USPC ..... 417/65, 73, 209
See application file for complete search history.

(56) References Cited

U.S. PATENT DOCUMENTS 3,185,106 A * 5/1965 Smith ..... F04F 1/16 417/51
3,360,733 A * 12/1967 Vali ..... G21K 1/003 315/500
3,374,743 A * 3/1968 Stutely ..... F04F 7/00 417/65
3,746,860 A * 7/1973 Shatas ..... G21B 1/23 378/119
3,748,475 A * 7/1973 Shatas ..... G21B 1/23 376/145
3,897,173 A * 7/1975 Mandroian ..... F04B 9/08 417/73

(Continued)

OTHER PUBLICATIONS

W. Lotshaw, "Ultrashort-Pulse Lasers for Space Applications," The Aerospace Corporation, Crosslink Magazine, 2011, 9pgs. http://www.aerospace.org/crosslinkmag/spring-2011/ultrashort-pulse-lasers-for-space-.

(Continued)

*Primary Examiner* — Patrick Hamo
*Assistant Examiner* — Joseph S. Herrmann
(74) *Attorney, Agent, or Firm* — Duane Morris LLP

(57) ABSTRACT

Systems and method of compressing and storing fluids without rotating machinery or hydrated electrochemical. The system and method makes use of shock waves, created by plasma generated by exposing the fluid to an ultrashort wavelength laser pulse from a femtosecond laser, and the fluid guided by check valves that create vortexes to resist backflow. The fluid and plasma being accumulated and recombined in a storage chamber in a compressed state.

18 Claims, 9 Drawing Sheets

(56) References Cited

U.S. PATENT DOCUMENTS

| | | | | |
|---|---|---|---|---|
| 3,898,017 | A * | 8/1975 | Mandroian | F04B 19/24 417/65 |
| 5,357,757 | A * | 10/1994 | Lucas | F03G 7/002 62/467 |
| 9,765,271 | B2 * | 9/2017 | Myrick | C06B 45/30 |
| 2006/0051214 | A1 * | 3/2006 | Ussing | B01J 19/0093 417/51 |
| 2011/0139185 | A1 * | 6/2011 | Chapin | B08B 7/00 134/19 |
| 2013/0064340 | A1 * | 3/2013 | Latkowski | G21B 1/03 376/146 |
| 2013/0162136 | A1 * | 6/2013 | Baldwin | H01J 1/02 313/311 |

OTHER PUBLICATIONS

C.G. Parigger et al., "Measurement and Analysis of OH Emission Spectra Following Laser-Inducted Opitcal Breakdown in Air," PubMed, Applied Optics, 42(30), 2003, 1pg. http://www.ncbi.nlm.nih.gov/pubmed/14594055 Abstract, Complete Copy Not Provided.

K. Rohlena et al., "Influence of the Laser Spark Generation Mechanism on Electric and Magnetic Fields in its Vicinity," Institute of Physics, A.S.C.R., 40th EPS Conference on Plasma Physics, 4pgs.

N.W. Jalufka, "Laser-Powered MHD Generators for Space Application," National Aeronautics and Space Administration, NASA Technical Paper 2621, 1986, 14pgs.

A. Lazarian,"Turbulence in Atomic Hydrogen," Princeton University Observatory, Princeton, N.J. 08544, 1998, pp. 119-129

B. Ryden et al., "Foundations of Astrophysics," Instructor Solutions Manual, Addison-Wesley, 1st edition, 2010, 16pgs.

C. Bree, "Self-Compression of Intense Optical Pulses and the Filamentary Regime of Nonlinear Optics," PhD diss., Humboldt-Universitat zu Berlin, MathematischNaturwissenschaftliche Fakultat I, 2011.

C. Kohler et al., "Saturation of the Nonlinear Refractive Index in Atomic Gases," Physical Review A 87 (4), 2013, 9pgs.

J. Ju et al. "Femtosecond Laser Filament Induced Condensation and Precipitation in a Cloud Chamber," Scientific Reports 6, Article No. 25417, 2016, 23pgs. https://www.nature.com/articles/srep.

G.K. Batchelor, "An Introduction to Fluid Dynamics", Department of Applied Mathematics and Theoretical Physics, Cambridge England, University of Cambridge, 1967, 1 pg.

N.A. Bobrova et al., "MHD Simulations of Plasma Dynamics in Pinch Discharges in Capillary Plasmas," Laser and Particle Beams 18, 2000, pp. 623-638.

R.O. Cleveland et al., "The Physics of Shock-Wave Lithotripsy," vol. 11, 3rd Edition, Smith's Textbook of Endourology, Chapter 38, 16pgs.

R. Fabbro et al., "Physical Study of Laser-Produced Plasma in Confined Geometry", Journal of Applied Physics, vol. 68 (2), Jul. 15, 1990, pp. 775-784.

S. Fujioka et al., "Kilotesla Magnetic Field Due to a Capacitor-Coil Target Driven by High Power Laser," Applied Physics, Scientific Reports 3, Article No. 1170, 2013, 18pgs. https://www.nature.com/articles.srep01170.

P. Gregorcic et al., "Two-Dimensional Measurements of Laser-Induced Breakdown in Air by High-Speed Two-Frame Shadowgraphy," Applied Physics A, Materials Science & Processing, Springer, 2012, 7pgs.

B.M. Heineike, "Modeling Morphogenesis with Reaction-Diffusion Equations using Galerkin Spectral Methods," Trident Scholar Project Report No. 296, Naval Academy, Annapolis, MD, 2002, 92pgs.

L.F. Henderson, "General Laws for Propagation of Shock Waves through Matter," Handbook of Shock Waves, Department of Mechanical Engineering, University of Sidney, vol. 1, 2001, Chapter 2, 38pgs.

K. Holtappels, et al., "Hydrogen Storage in Glass Capillary Arrays for Portable and Mobile Systems," Fuel Cell & Hydrogen Energy, 2009, 8pgs.

T. Hosokai et al., "Application of Fast Imploding Capillary Discharge for Laser Wakefield Acceleration," Proceedings of the 1999 Particle Accelerator Conference, New York, IEEE 1999, 3pgs.

J. E. Cates et al., "Shock Wave Focusing Using Geometrical Shock Dynamics," American Institute of Physics, Physics of Fluids vol. 9, No. 10, 1997, 11pgs.

O.J. Shariatzadeh et al.,"Computational Modeling of a Typical Supersonic Converging-Diverging Nozzle and Validation by Real Measured Data," Department of Mechanical Engineering, Cutin University, 2014,, 6pgs.

M. Litos et al., "High-Efficiency Acceleration of an Electron Beam in a Plasma Wakefield Accelerator," Nature, vol. 515, Macmillan Publishers Limited, 2014, 10pgs.

* cited by examiner

ULTRASHORT PULSE LASER-DRIVEN SHOCK WAVE GAS COMPRESSOR

RELATED APPLICATION

The present application is a utility of and claims priority benefit of provisional application nos. 62/328,135 filed on 27 Apr. 2016 entitled "Ultrashort Laser Driven Shock Wave Compressor Using Laser Driven Mechanism"; 62/328,137 filed on 27 Apr. 2016 entitled "Ultrashort Laser Driven Shock Wave Compressor Using Laser Driven Mechanism"; 62/328,141 filed on 27 Apr. 2016 entitled "Ultrashort Laser Driven Shock Wave Compressor Using Laser Driven Mechanism"; 62/328,147 filed on 27 Apr. 2016 entitled "Ultrashort Laser Driven Shock Wave Compressor Using Laser Driven Mechanism" and 62/328,151 filed 27 Apr. 2016 entitled "Ultrashort Laser Driven Shock Wave Compressor Using Laser Driven Mechanism". The present application also claims priority benefit of U.S. Provisional Application No. 62/491,104, filed 27 Apr. 2017 and entitled "Laser Beam Arrays for Compressor/Gas Generator/Plasma Generator". The entirety of each of the above-listed applications are hereby incorporated herein by reference.

FIELD OF THE DISCLOSURE

The present disclosure relates generally to fluid compression, and more specifically to systems and methods of compressing hydrogen via plasma generation, precluding the need for rotating machinery or hydrated electrochemical.

BACKGROUND

Production and storage of compressed hydrogen in any form such as conventional compressed gas, liquid, hydrides, nanotubes, capillary arrays, and microspheres is a big issue among energy industries. The U.S. Energy Department has stated that hydrogen compression and storage problems are a major obstacle in the commercialization of hydrogen cars, trains, ships, drones, bus, and trucks. The conventional piston compressors have many moving parts requiring lubrication and service to prevent wear. In addition, hydrogen is about 16 times lighter than air, combustible and is difficult to compress and store safely due to leakage. The conventional compressor must be delicately and finely machined to assure tight fit to prevent hydrogen gas from escaping into the surroundings. Excellent sealing is also essential for conventional compressor to prevent lubricants from contaminating the hydrogen gas. Hydrogen gas can be easily contaminated resulting in substandard performance and increased costs. These are contaminants typically include CO2, N2, O2 as well as other gases in the working environment. These issues remain a problem for hydrogen filling stations and even for power plant generators.

The costs of transportation, equipment maintenance, renting cylinders for storage, operating cooling generators may be prohibitive to developing machinery for a future hydrogen economy, as these systems will have to handle up to thousand cubic meter of hydrogen per day. A device which can be made inexpensive, with no moving parts, and requires very little maintenance may advantageously overcome these current limitations in these systems.

The laser driven plasma-shock-acoustic wave compressor described herein resolves many if not all these problems and critical issues. The disclosed subject matter replaces the metal piston of a conventional compressor and hydrated electrochemical with a specially pulsed laser to provide the compressive energy. Pressure from plasma generation provides the compression action. In the near term and beyond a large market potential in the hydrogen gas will be in providing portable fueling stations for buses, ships, drones, aircraft, trains, and automobile fleets. The discloses subject matter is ideally suited for use in small portable fuel pumping that can be great benefit to consumers. Additionally, the disclosed subject matter when used in series or parallel may achieve greater scale and application.

The potential applications of the disclosed subject matter, such as the charging of fuel cells, airbags, replenishment for cooling power plant generator, production of ethylene and in die-casting processes exists where conventional compressor types have long dominated. A wide variety of electronics manufacturers use hydrogen as a carrier gas for thin-film deposition, cleaning and as a reducing agent in furnace treatments. Another advantage of the disclosed subject matter is that it makes very little noise and has a smaller footprint along with reduced weight compared to current compressing devices and methods. Lower capital costs, increased safety benefits and the reduction of operating cost of the disclosed subject matter in comparison with hydrogen cylinder rental, and cylinder handling will greatly benefit all users. The resultant compressed gas (H, O, CO2, N2, etc.) for the disclosed subject matter may be used for energy carriers, fuel resources, cooling systems, heat engines, semiconductor manufacturers, fuel cells, fireless steam energy, magnetohydrodynamic (MHD) power generation, and many other potential applications.

SUMMARY

A gas compressor contains a gas inlet, a compressed gas outlet and a gas passage between a gas inlet and compressed gas outlet. The gas passage is made up of a first check valve biased against flow towards the inlet, a nozzle downstream from the first portion and having a focal point located within, a diffuser, a capillary connecting the nozzle and diffuser, a second check valve biased against flow towards the inlet and located between the diffuser and the gas outlet, a storage chamber downstream of the second check valve, and a pulsed laser configured to direct a beam upon the focal point.

Hydrogen is ideal for the compressor due to its simple structure. When designed for 2 dimensional flow each of the first and second check valves comprise a plurality of successive triangular chambers. For both two dimensional and three dimensional flow the first and second check valves, nozzle, capillary, and diffuser are concentric with a central axis. The pulse laser is configured with one or more elements from the group comprising fiber optics, mirrors and lenses. The pulse laser may consist of a plurality of lasers configured to direct respective beams upon the focal point.

The storage chamber consists of a core surrounded by an outer shell, which may be in thermal communication with a heat sink. The core further has a plurality of grooves which interface with the outer shell to form a third portion of the gas passage. The core may make use of a plurality of tunnels thru the core, which connect the plurality of grooves, and are in fluid communication with the plurality of grooves.

At least one of the first and second check valves produce a portion of the gas passage defined between an inner conical surface and an outer conical surface. In a two dimensional embodiment, at least one of the first and second check valves comprise a portion of the gas passage having plurality of successive wedge shaped chambers having a constant thickness.

Gas compression occurs by, first providing gas at a first pressure at a focus area in a nozzle downstream of a first set of check valves and upstream of a diffuser; then pulsing a laser beam on the focus area; which results in transforming gas at the focus area into plasma; thus forming a shock wave that expands in all directions; which is controlled by restricting upstream flow by the first set of check valves; this results in advancing the shock wave downstream through a second set of check values downstream of the diffuser; causing the effect of pumping gas through the second set of check valves via a pressure gradient caused by the shock wave; this is further controlled by restricting upstream flow with the second set of check valves; and, finally resulting in accumulating gas and plasma in a storage chamber downstream from the second set of check valves and transferring heat away from the chamber; this is possible without moving parts because the first set of check valves, nozzle, diffuser, second set of check valves and chamber are in fluid communication.

The method may require filtering out undesired laser beam wavelengths prior to the focal area. If desired the method can make use of focusing a plurality of laser beam upon the focus area. This can be accomplished by directing the laser beam to the focus area by one or more of the group consisting of mirrors, lenses, and fiber optics. The method enables a condition wherein the first pressure is lower than an inlet pressure and the chamber pressure is greater than the inlet pressure. The method of controlling flow direction involves restricting upstream flow by generating vortices within each set of the check valves. Shock wave formation is achieved rapidly expanding the gas and plasma.

A hydrogen gas compressor contains a gas inlet; a compressed gas outlet; a gas passage between a gas inlet and compressed gas outlet. The gas passage is made up of a first check valve biased against flow towards the inlet, consisting of a first portion of the gas passage defined by a series of conical surfaces and an outer stepped conical surface; a nozzle downstream from the first portion and having a focal point located within and connected to a diffuser by a capillary, the nozzle, capillary and diffuser being concentric with the conical surfaces of the first check valve; a second check valve biased against flow towards the inlet and located between the diffuser and the gas outlet; the second portion of the gas passage defined by a second inner stepped conical surface and a second outer stepped conical surface; the steps of the inner and outer conical surfaces are axially offset from one another; a compressed hydrogen gas storage chamber made up of a core with a plurality of grooves surrounded by an outer shell and a plurality of tunnels defined through the core interconnecting ones of the plurality of tunnels; a femtosecond laser configured to direct a beam upon the focal point; and a band pass filter positioned between the laser and the focal point; the first check valve contains an optical passage from the pulse laser to the focal point.

DETAILED DESCRIPTION

Figure 1:
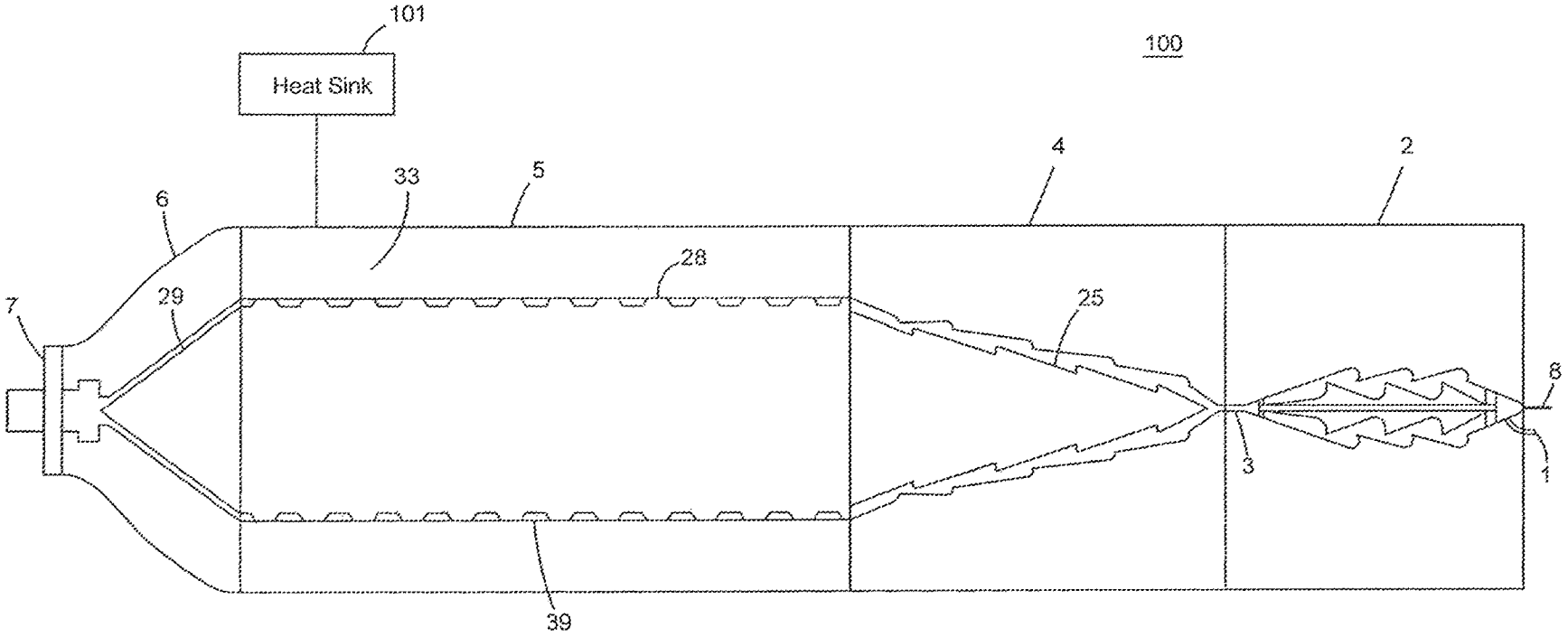
FIG. 1. Depicts an embodiment of the plasma shock compressor depicting the four chambers of the compressor.

For the purposes of promoting an understanding of the principles of the disclosure, reference will now be made to a number of illustrative embodiments illustrated in the drawings and specific language will be used to describe the same.

This disclosure presents embodiments to overcome the aforementioned deficiencies in gas compression systems and methods. More specifically, the present disclosure is directed to systems and method of compressing hydrogen through plasma generation, precluding the need for rotating machinery.

A component of the disclosed subject matter is the application of a pulsed laser. A femtosecond laser is a laser which emits optical pulses with a duration well below 1 ps (→ultra-short pulses), i.e., in the domain of femtoseconds (1 fs=$10^{-15}$ s). A femtosecond laser module operates using a small energy to produce tiny thermonuclear detonation. This creates supersonic exothermic front accelerating through a medium that eventually drives a shock front propagating directly in front of it. The laser-driven mechanism consists of a laser oscillator module, pulse picker, isolators, chirp pulse amplification, partial mirror reflector, beam dump, and lens focusing components or fiber optics.

Most femtoseconds pulse laser modules come with a typical fixed repetition rate of a few MHz. However, in the disclosed compressor a pulse picker with a high voltage (HV) power supply, RF electronic controller, and pulse generator also work in conjunction with the pulse laser. Electro-optical modulators have crystal like rubidium titanyl phosphate, deuterated potassium dihydrogen phosphate, or beta barium borate, assembled together with the polarizer, and properly driven with the high voltage electronics, such that the pulse picker can select and transmit some of optical pulses from the pulse train and reject all others. The laser produces an ultrashort wavelength pulse, as a side note, tis ultrashort laser technology may open up the new Femto-chemistry field and semiconductor switching. The femtosecond scale time typically requires optical technology since electronic technology is not able to respond near speed of light at terawatt target areas under controllable conditions. The laser beam energy or irradiance may be increased by the number of lens arrays or fiber core diameters (both should have high fill factor and/or be tiled) without losing the ability to support primarily single-mode pulse propagation. Using uniform irradiance and higher fill factor closer to 100 percent will produce better beam quality (increasing power-in-bucket) and high energy concentrated in the central lobe. The beamlets of array should be arrayed closely together and/or tiled at the output aperture. This method will produce near 100 percent of a fill factor. This is one set of beam arrays. The size of the capillary or small pipe can be increased by increasing the number of beam array sets. This method is not just focusing to one spot size, but also in several spots separately. Several spots on target area will detonate gas or liquid in much large area that creates plasma shockwave front. This array soliton sources produces (from several laser spot size target area) into Peregrine Soliton. This complex engineering is also not limited to different location of the array soliton sources (phenomenon effects from several spot size target area). It is possible to obtain 100-fs pulses or few fs pulses with an average power of up to 100 W or more by scaling up the present subject matter, or as described earlier numerous compressors by be arranged in series or parallel to reach scales required for some applications. The production of such high levels of average power will likely make ultrafast fiber laser technology the workhorse femtosecond laser system of the future.

In the disclosed subject matter, the focused laser interacts with the source hydrogen. The ultrashort pulse of the laser and the pondermotive force separate the hydrogen's protons and electron forming a plasma. When ultrashort laser pulse lasers are applied toward the target area, Ponderomotive force arises very significantly whenever there is a very high intensity gradient of pulsed laser light bullets of a few wavelengths width. The pressure exert as a result of these pulses is enormous. The pressure is an energy density. The standard of quantum mechanics in atomic-molecular of hydrogen start to change around greater than $10^{12}$ $Wcm^{-2}$ when applied to the ionization of atomic hydrogen in a laser field. This fast ignition gas (breakdown) is characteristic of intense laser-matter interaction. The speed of the plasma front may reach 100 km/s.

The plasma production proceeds in two steps. The first step is initial ionization, which can be accomplished in a gas by multi-photon absorption. After free electrons are produced, they are further heated by inverse bremsstrahlung resulting in a cascade process in which the energetic electrons produce further ionization by collision with the neutral atoms and ions. Once this latter stage is reached, the laser intensity required to maintain the plasma drops to a value equal to the loss rate from the plasma. This is typically of the order of a few kilowatts.

The absorption coefficient (in $cm^{-1}$) for inverse bremsstrahlung is given by:

$$\alpha = \frac{(7.8\times10^{-9})Zn_e^2\ln\wedge(\nu)}{\nu^2T_e^{3/2}(1-\nu_p^2/\nu^2)^{1/2}}$$

where Z is the ionic charge, $n_e$ is the electron density in $cm^{-3}$, $\Lambda$ is the high-frequency screening parameter, $T_e$ is the electron temperature in eV, $\nu$ is the laser frequency, and $\nu_p$ is the plasma frequency. Coupling of the laser energy into the plasma is most efficient if the electron density of the plasma is such that $\nu_p$ is close to $\nu$. The absorption depth (i.e., the distance the laser radiation penetrates into the plasma) is given by $\alpha^{-1}$. Because of the strong dependence of $\alpha$ on the electron density and electron temperature, the plasma parameters may be varied to achieve maximum absorption of any laser radiation in a fixed distance. If the electron density of the plasma reaches the critical density given by:

$$n_c=(1.24\times10^{-8})\upsilon^2$$

then the laser beam does not penetrate into the plasma but is reflected instead. This situation results in a laser-supported detonation (LSD) wave propagating from the plasma surface along the laser beam toward the laser. These waves move at supersonic speeds and ionize and heat the medium through which they are propagating.

During an ultrashort time, laser light pulse travels only a distance of $\simeq$1.5 μm in vacuum. This pulse duration is not per se a laser beam in the traditional sense, but rather a laser light bullet (however, the two terms are used herein interchangeably). The laser light bullet consists of oscillation of electric field in group velocity, $\upsilon_g$. The Lorentz force on an electron exposed to a space varying electric field E(x,y,z). The time average of this non-linear force is given by:

$$F_{NL}=-\nabla U_p$$

where $$F_{NL}=-e[E(r,t)+\upsilon\times B(r,t)]$$

where $F_{NL}$ (Lorentz Force) is acting on a particle of electric charge e with instantaneous velocity $\upsilon$, due to an external electric field E and magnetic field. Note that there is no $\nu\times B$ force due to making dipole approximation that implies the omittance of the magnetic field.

Ponderomotive force is a nonlinear force that a charged particle experiences in an inhomogeneous oscillating electromagnetic field. This ponderomotive force is defined by gradient of ponderomotive energy. During focusing ultra-high intensity laser beam in plasma, two different ponderomotive forces are in action due to two different gradients. They are radial and longitudinal ponderomotive forces. Radial ponderomotive force on electrons is directed radially outwards.

$$F_p\propto-\nabla I$$

where I is the intensity.

This mechanism produces focusing bunches of electrons during acceleration against distance and time. Also, in time, the intensity is varying and there is longitudinal ponderomotive force on the electron in the direction of beam propagation.

This ponderomotive force due to the transverse electric field gradient of the laser beam will push the plasma electrons radially outwards, thereby creating a radial field which will focus the electron beam axially.

Note, if another laser pulse of same duration is injected instead of the e-beam at a lag of $1.5\lambda_p$, the wake field of this pulse will be opposite and will try to cancel out the field of the previous pulse. As a result, the energy of the photons in the second pulse will get increased. This is the concept of a Photon Accelerator. In this respect adding another laser beam at a different location using pulse trigger mechanism following lag pulse may be possible.

A longitudinal ponderomotive force as described above is defined as:

$$F_p \propto -\frac{\partial I}{\partial Z}$$

where I is the intensity.

These net ponderomotive forces are used in the concept of Laser Wake Field Accelerator. While the Electromagnetic field is in transverse and thus cannot be used to accelerate electrons, there are various ways to use transverse laser field to generate longitudinal field gradient to accelerate electrons. The laser is able to excite Langmuir wave in the plasma such as fast ignition and these are longitudinal waves. Hence, this mechanism as described may also be used to accelerate electrons.

In the disclosed subject matter, the net ponderomotive forces effect on gas medium act as an impulse piston that produces shock waves and compression waves at higher velocity and pressure along the boundaries conditions, such as a channel or capillary. From this "piston" corresponding to the motion of a gas is under the action of an impulsive load. A pressure pulse of ultrashort duration is applied to the external surface of the gas, whereas, the gas surface is subjected to an impulsive load. The compressive wave is then following behind the shock wave. The restricted flow valves (check valves) of the cone will reflect and deal with this extreme shock wave propagation.

The shock waves undergo dissipative processes such as acoustic and heating results. This is an important and necessary step for the shock wave gas compressor where the plasma bullet may further propagate beyond what is required for compression. The plasma density will also undergo dissipative processes as a function of time and distance. The impulsive piston load mechanism using plasma density at fast ignition using medium gas is only required and necessary in gas compressor processes.

As noted previously, a pressure pulse of ultrashort duration is applied to the external surface of the gas. The gas surface is subjected to an impulsive load. Ultrashort laser-driven mechanism is one of the various methods that are possible for producing an impulsive load. In ultrashort time interval, $\tau$, a plane piston is pushed into a gas with a constant velocity $U_1$, creating a pressure $\Pi_1$ in the gas. The pressure is defined and given as:

$$\Pi_1 \approx \rho_0 U_1^2$$

where $\rho_0$ is the gas density depends on the specific heat ratio $\gamma$.

The velocity of the shock $D=u_s$ that is created by the action of the piston is close to $U_1$. After a time interval $\tau$ the piston is then instantaneously withdrawn.

A thin layer of coulomb explosive is detonated on the gas surface. When the mass thickness of the layer is in units of mass per unit of area and the energy released per unit mass is Q, the energy is released by the explosion per unit area is defined as:

$$E=mQ$$

The explosion products expand with a velocity $U_1 \approx \sqrt{Q}$. The products expand in both directions and since prior to the detonation the gas is substantially at rest, the total momentum is equal to zero. However, the momentum of the detonation products moving in one direction is in order of magnitude, equal to $I \approx mU_1 \approx m\sqrt{Q}$ (per unit surface area). The detonation products generate a shock wave in the gas with a pressure on the order of $\Pi_1 \approx \rho_0 U_1^2$. The time $\tau$ over which the pressure acts as determined from the condition that in the time $\tau$ the energy and momentum are transferred from the detonation products to the gas, $$\tau \approx \frac{E}{\Pi_1 U_1} \approx \frac{I}{\Pi_1} \approx \frac{m}{\rho_0 \sqrt{Q}}$$

During this time, the shock wave in the gas will travel through a distance $\sim U_1\tau \sim (Q\tau)^{1/2}$ and will encompass a mass $\sim \rho_0 (Q\tau)^{1/2} \sim m$, a mass of the order of the mass of the explosive.

A thin plate with a small mass per unit area is made to strike the gas surface with a velocity $U_1$. The impact of the plate creates a shock wave in the gas which propagates with the velocity $D \approx U_1$. The pressure in the gas will then be $\Pi_1 \approx \rho_0 U_1^2$. The initial momentum and energy of the plate, $I=mU_1$ and $E=mU_1^2/2$, are transferred to a gas during the time $\tau$ in which plate is decelerated, which is the order of $\tau=E/\Pi_1 U_1 \approx I/\Pi_1 \approx m/\rho_0 U_1$. During this time, the shock wave in the gas travels through a distance $U_1\tau$ and encompasses a mass, $\rho_0 U_1 \tau \approx m$.

There is pressure acting on the surface of the gas which drops rapidly with time. The pressure can be expressed in the form $p_p=\Pi_1 f(t/\tau)$ where f is a function which characterizes the shape of the pressure pulse. The "piston" concept will be used for this example. The motion of the gas can be determined using the functions p(x,t), $\rho$(x,t), and u(x,t) after a time is large in comparison with impact time $\tau$. The solution to this problem should answer the questions of how the pressure $\Pi_1$ must increase as $\tau \rightarrow 0$, in order to ensure that the pressure in the gas be finite after a finite time, t.

A plasma bullet will travel behind the shock and compression wave following in medium gas. However, the relativistic and non-relativistic of the shock wave depends on the strength of intensity of the laser-driven mechanism and the area of the target.

Note that $U_p$ is not the same energy comparison with E=mQ due to the difference of pressure mechanism processes. In another words, the light radiation pressure from pulse light laser is a different mechanism from the detonation products (use gas medium) that cause "piston" acts as pressure on rest gas medium. $U_p$ produces powerful electrostatic force (acts dielectric similar to capacitor model) toward the plate of gas where E=mQ produces into detonation products (atomic-molecular follows coulomb explosion) first and then acts as piston force that creates into shock wave process. However, $U_p$ is greater than or closer to E=mQ where Q comes from $U_p$ process. This momentum process somewhat follows relativistic physics as quantum mechanism, too. This modeling can be adjusted using a plasma thruster design for much greater force.

The leftover plasma is still in process behind the shock wave where the higher radiation heat (shock) wave propagates upfront first. However, this plasma needs to be dissipative through radiation emissions, heat, and acoustic emissions safely along the boundary distance. Then, the plasma returns back to atomic-molecular recombination process while traveling along the boundary conditions.

The gas flowing through the check valve nozzle is forced by the pressure gradient from the passage confinement to an exit. At any point in the nozzle valve, the pressure upstream is greater than the pressure downstream. Hence, the general differential force or net accelerating force is also given as $$dF=pA-(p-dp)A \rightarrow dF=\tau dA$$

where $\tau$ is viscous pressure and dA is the differential area.

In the check valves, the flow is bias by the creation of vortices. The larger the vortex, the more resistance force is against the undesired direction of fluid flow. The momentum equation generally is used to calculate the reaction thrust of a fluid or gas jet is expressed as:

$$F = \rho Q v - F_R \rightarrow F \approx \iint_{A_b + A_f} p\hat{n} \cdot dA - p_{op} A_0 = \oint p dA - p_{op} A_0$$

where F is the thrust force, ρ is the density of fluid or gas, Q is the measured flow rate, ν is the mean velocity of the flow through the nozzle, $F_R$ is force resistance acting on check valve, $A_b$ is the back area of the high pressure chamber, $A_f$ is the front area of the high pressure chamber, p is the system pressure, $p_{op}$ is the operating pressure (the environmental pressure), $A_0$ is the outlet area of the conical nozzle, and n̂ is unit vector tangent and normal to the differential area element dA.

Therefore, the total force includes the retarding (resistance) forces that are vortex force resistance (neutral force at nearly to zero unless greater viscous dissipation) and tank pressure is written generally as:

$$F = \oint p dA - p_{VR} dA_C - p_t A_e = \oint p dA - \tau dA_C - p_t A_e \approx \iint_{A_v + A_f} p\hat{n} \cdot dA - \tau dA_C - p_{op} A_0$$

These complex equations are also similar and important as applied to conical valve thrust reaction force. Using Computational Fluid Dynamic (CDF) modeling simulator will help and determine the right parameters for these accurate results. These equations show the applied force from focus zone or containment glass must be greater than the retarding forces in order to accomplish the desired results.

The purpose of the check valves is to keep or reserve the shock pressure inside the containment glass before leaking toward exit outlet. Shock wave or impulse momentum force from laser beam is perpendicular to the exit force or outlet fluid flow. Therefore, the first response of laser induces shock wave or impulse momentum force is much faster than the response of exit gas or liquid flow output. Another possible way is to keep only pressure tank for resistance force, $-p_{op}A_0$, without using check valves. If the fluid is in reversing flows then the term, $-p_{op}A_0$ is increasing its resistance force.

A laser beam bore tube can be designed in different ways such as charging different type of gas element (higher gas breakdown characteristic) inside bore tube and seal with optical windows. This allows laser beam travel longer without any interfacing from nonlinear Kerr effects (breakdown at specific focus length than desired focus length).

The further detailed analysis shows that on two transverse dimension spatial solitons (time and distance) are unstable in a pure Kerr medium. These are also not limited to gas; liquid, and even solid material act as linear and nonlinear medium (refractive index). This can happen in self-focusing or focusing to unexpected ionization regions (ignited spot) at some distance and time during nonlinear beam propagation in any medium state. The solution to this limited damaged threshold material is resolved by engineering the right method of laser beams propagation target area toward the wall channel of the taper chamber safely and in a stable manner.

The disclosed subject matter using high power fiber or optic components with laser beams propagation method is dealing with limited damaged threshold target material. These issues are resolved by using gaseous medium surrounding the space region and a channel tube that can be used for reversal processes. Hence, it keeps its operation stable and continual at longer lifetime. There are several different wave equations to deal with these linear and nonlinear effect processes. The linear effect is the beam propagation model in which the effects of diffraction, group velocity dispersion (GVD), and the instantaneous and retarded Kerr effect include the higher order-order Kerr effect. The nonlinear effect is another beam propagation model for the nonlinear Kerr effect, plasma self-focusing and defocusing, and multiphoton absorption (MPA).

The model equation from Chiron, et. al paper did not use two dimensions (r,z) and time propagation [2-D+1 (time) propagation] model equation. Instead, their modeling deals with studying what consequence results would be from $\Delta N \ll N_0$. Since $N=kc/\omega$, it follows that $1/\omega \ll 1$ and thus the time dependent term is small. However, the pulse paraxial wave equation should be adding time dimension [2-D+1 (time)=3D modeling (r,z,t)] to determine the group velocity versus time and distance that can be simulated for channel modeling correctly.

The scalar envelope ∈(r, z, t) assumed to be slowly varying in time and along z and evolves according to the propagation equation. The Kerr effect beam for a cylindrical symmetry around the propagation axis z is written as:

$$\frac{\partial \varepsilon}{\partial z} = \frac{i}{2k_0} T^{-1}\left(\frac{\partial^2}{\partial r^2} + \frac{1}{r}\frac{\partial}{\partial r}\right)\varepsilon - i\frac{k'}{2}\frac{\partial^2}{\partial \tau^2} - i\frac{k_0}{2\omega_0^2} T^{-1}[\omega_p^2(p)\varepsilon] + ik_0 n_2 T[|\varepsilon|^2\varepsilon] - \frac{1}{2}\frac{\sum_q \rho_q W_q U_q}{|\varepsilon|^2}$$

where τ refers to the retarded time variable $t-z/\upsilon_g$ with $\upsilon_g = \partial\omega/\partial k_{\omega_0}$. Courtois, C., Couairon, A., Cros, B., Marques, J. R., & Matthieussent, G. (2001); Propagation of intense ultrashort laser pulses in a plasma filled capillary tube: Simulations and experiments. Physics of Plasmas, 8(7), 3445-3456. The terms on the right-hand side of this equation account for diffraction within the transverse plane, group velocity dispersion with coefficient $k'' = \partial^2 k/\partial\omega^2|_{\omega_0}$, defocusing due to the plasma with electron density ρ, self-focusing related to the Kerr effect, and absorption due to tunnel ionization. The operator $T=1+(i/\omega_0)\partial\tau$ in the nonlinear polarization gives rise to self-steepening effects and $T^{-1}$ in front of the diffraction term accounts for space time focusing. By taking this operator into account, the cross derivative $\partial^2 z, \tau$ which appears in the wave equation expressed in the reference frame of the pulse through the retarded time variable τ. is taken into account. The nonlinear polarization parameter is important and explains using the susceptibilities values that describe the medium in saturated gas ionization.

The laser pulse is initially focused on the entrance plane of the channel tube of bore radius a (taper chamber). During this focusing stage, the Kerr effect propagation supplemented by the system charge densities and ionization rates equations describe the complete evolution of the laser pulse and the plasma created by photoionization, under the effects of diffraction, dispersion, plasma defocusing and absorption, self-focusing, self-steepening, and space time focusing. When the laser pulse reaches the entrance plane of the channel or capillary tube, the on-axis (r,a) part of its energy is projected on the different modes defined in the next section, while the off-axis (r,a) part is lost in the entrance wall of the wave guide.

This laser bore tube can be used with either fiber optics or without (use optic lens), one laser beam or an array of beams. The array beams can be done in several different methods such as using multi-fibers or lens array components, parabolic mirror or right angle mirror, and focusing lens. The focus lens can be designed in different ways such as collimator, beam expander, and air-spaced achromatic doublets or triplets lens to meet desired output spot size at excellent beam quality. Doping fiber, hollow core fiber, or Bragg grating fiber can be used inside laser bore hole of the check valve device. The diffuser shape can be designed to minimize turbulence, and probe laser target area requirements. The method of man-made turbulence gas flow is another option that can be designed to act as a self-focusing lens for ultrashort laser beam. This phenomenon effect can be done with self-focusing lens by changing the index refraction that depends on the dynamic density of gas flows. This mechanism is another option for self-focusing and then de-focusing at limited desired distance. This can work using either focusing or Kerr effect propagation. Using either one beam or arrays beams can deal with gas turbulence in the target area.

Laser prism mirrors have multilayer dielectric coating which have higher damage threshold, durability, better mechanical hardness. Also, laser prism mirrors usually are at 45 degree angle for higher reflection than the metallic coating mirrors.

This is another possible option that would help gas inlet tube flow faster and straighter easily. Check valve chamber can be designed and use different gas filled chamber for high power laser beam. The purpose of this method is to prevent gas breakdown and thermal management before reaching longer target distance area. This would help to minimum gas filament generation. The focus length will be determined to meet the threshold gas breakdown before reaching its longer focus target area.

The laser-induced plasma generation is produced by focusing the pulsed laser beam onto a small volume of gas. When the electric field of the laser radiation near the focal volume exceeds the field binding the electrons to their respective nuclei, it triggers breakdown of the gas molecules and ionizes the gas in the focal volume. The resulting plasma is opaque to the incident laser radiation and absorbs more energy, resulting in further ionization. This generates a cascade effect. Energy is preferentially absorbed towards the laser source, and hence an elongated tear-drop shaped spark is produced at the end of the laser pulse. The collision of energetic electrons with heavy particles heats the gas. The resulting de-energized electrons recombine with heavy particles, and the electron number density decreases as a result. Very high temperatures and pressures are obtained at the end of plasma formation. The resulting pressure gradients cause a blast wave which then propagates into the background gas. As the blast-wave propagates into the background, it poses an interesting fluid dynamic problem. The blast wave is initially tear-drop shaped but becomes spherical as it propagates. During this period, the strength of the blast wave varies over two orders of magnitude. The flow field behind the blast wave results in rolling up of the plasma core, and formation of toroidal vortex rings.

The flow field resulting from laser-induced breakdown in isotropic turbulence is simulated using the compressible Navier-Stokes equations. Ghosh and Mahesh present the details of numerical method and the equations of the conservation of mass, momentum, energy, the continuity equation, Ducros limiter and variable, vorticity, velocity magnitude and pressure, turbulence, and shock formation that can be written for simulating plasma-shockwave propagation modeling. This would happen inside the wall channel of the check valve chamber.

The work done from the shock wave propagating against the internal pressure (Young modules of glass capillary and bulk module of gas or fluid) in the confinement of cold materials has been dissipated and loses its energy. This work done also resists compression materials confined by geometry (either gas or fluid). The distance of dissipation at which the shock wave stop defines the boundary of the shock affected area. At this stopping point, the shock wave converts into an acoustic wave (sonic). This sound wave propagates further into the material without inducing any permanent changed to solid materials. Eventually, this acoustic wave at resistance of Young modulus materials (tensile and compressive) convert into impulse momentum of shock wave.

The internal energy in the whole volume enclosed by the shock front uses the distance where the shock wave stop can be following to the absorbed energy:

$$E_{abs} \approx \frac{4\pi P_0 r_{stop}^3}{3} \Rightarrow r_{stop} \approx \left(\frac{3E_{abs}}{4\pi P_0}\right)^{1/3}$$

This equation determines the stopping distance obtained from the boundary conditions of cylinder confinement. At this point, the pressure behind the shock front is equal to the internal pressure of cold gas or fluid. The boundary between the laser affected on gas or fluid and glass confined corresponds to the radius distance where shock wave effectively stopped.

The acoustic wave continues to propagate at $r>r_{stop}$. This propagation wave is not affecting the properties of confinement and lens materials at its radius distance. Laser beam toward the gas or fluid filled capillary at target focus volume produces a hollow or low density region surrounded by a shell of the laser-affected material. This creates a void region spot. The strong spherical shock wave starts to propagate outside the center of symmetry (at target center of circle explosion) of the gas or fluid absorbed energy region. This micro explosion produces to compress the gas or fluid against the glass confinement. At this same time, a rarefaction wave propagates to the center of symmetry decreasing the density in the area of the energy deposition along the axis of laser beam target.

At this point, a strong spherical explosion is produced where gas or fluid density decreases rapidly in space and time, behind the shock front in direction to the center of symmetry of the glass confinement. The entire mass of gas or fluid inside the confinement material that spread at uniformly in the energy deposition region inside a sphere of radius, $r \sim l_{abs}$, is concentrated within a thin shell near the shock front at some time after the micro explosion. The gas or fluid temperature increases and its density decreases toward the center symmetry (circle) of shell confinement. The gas or fluid pressure is nearly constant along the radius.

A void surrounded by a shell of laser-modified gas or fluid was formed at the focal spot. The whole heated gas or fluid mass is expelled out of the center symmetry and remains after shock wave unloading in the form of shell surrounding the void.

This is possible because the fluid or gas has a low dielectric breakdown strength compared to higher dielectric strength of glass confinement at the greater strength of laser electric field (intensity). The mass conservation is relating to the size of the void to compression of the surrounding shell. No mass losses will occur in this condition of the confinement. The void formation inside gas or fluid confinement happens only when gas or fluid mass contained in the volume of the void is pushed out and compressed.

Therefore, the entire mass of gas or fluid confined in a volume with radius $r_{stop}$ resides in a layer in between $r_{stop}$ and $r_v$, which has a density, $\rho=d\rho_0$ where $d>1$.

$$\frac{4\pi}{3}r_{stop}^3\rho_0 = \frac{4\pi}{3}(r_{stop}^3 - r_{void}^3)\rho$$

The compression ratio can be expressed through measured radius, $r_{void}$, and the radius of laser affected zone, $r_{stop}$, is given as:

$$\frac{r_{void}}{r_{stop}} = (1-\delta^{-1})^{1/3}$$

The micro-explosion can be considered as a confined one when the shock wave affected zone is separated from the outer shell boundary of sapphire by the layer of thickness of fluid or gas. The gas or fluid boundary is larger than the size of this micro explosion zone. The thickness of gas or fluid layer should be equal to the distance at which laser beam propagates without self-focusing, $L_{s-f}$ $(W/W_c)$:

$$L_{s-f} = \frac{2\pi n_0 r_0^2}{\lambda}\left(\frac{W_0}{W_{cr}} - 1\right)^{-1/2} = mr_{stop}$$

where W is the laser power, and $W_c$ is the critical power for self-focusing:

$$W_{cr} = \frac{\lambda^2}{2\pi n_0 n_2}$$

where $n_0$ is glass index of refraction, $n_2$ is gas index of refraction, and $\lambda$ is wavelength of laser.

The laser power is given as:

$$W=E_{las}/t_p$$

where $E_{las}$ is energy per pulse and $t_p$ is pulse duration.

The absorbed energy can be also expressed as:

$$E_{abs}=AE_{las}$$

where A is focus spot area.

Therefore, the radius of shock wave affected zone is connected by the equation:

$$r_{stop} \approx \left(\frac{3AWt_p}{4\pi P_{cold}}\right)^{\frac{1}{3}}$$

For conditions considered above, the maximum pressure for gas or fluid can be achieved safety on absorption volume confined inside the transparent crystal glass. This may be done without damage to the structure boundary of glass containment. Materials other than glass are also envisioned for the containment.

The maximum laser power at which micro-explosion remains confined and self-focusing does not affect the glass between the laser affected zone and gas or fluid boundary:

$$\frac{2n_0\pi r_0^2}{m\lambda}\left(\frac{4\pi P_{cold}}{3AW_c t_p}\right)^{1/3} = \left(\frac{W}{W_c}\right)^{1/3}\left(\frac{W}{W_c} - 1\right)^{1/2}$$

There is another effect in the focal zone that can influence the size of the volume absorbing the laser energy at laser fluence above the optical breakdown threshold. The intense beam with the total energy well above the ionization threshold valve (fluid or gas) reaches the threshold value at the beginning of the pulse. Laser energy increases and the beam cross-section where the laser fluence is equal to the threshold value of fluid or gas and glass, the ionization front, starts to move in the opposite to the beam direction. The beam is focused to the focal spot area, $S_f=\pi r_f^2$. The spatial shape of the beam path is a truncated cone with the intensity bounce out at any time. This gives fluence a direction independent of the transverse flow.

The threshold fluence is produced with a radius increasing at the beam cross-section as given:

$$r(z,t)=r_f+z(t)tg\alpha$$

where z is the distance from the focal spot, $r_f$ is a circle with radius, $\alpha$ is the angle between z and truncated cone of fluence, g (radiative) is the electrons diffusion rate where the first is the diffusion of electrons out of the focal volume.

During the pulse, the threshold fluence is given as [5]:

$$F_{thr} = \frac{E_{las}(t)}{\pi r^2(z,t)}$$

The ionization front moves the distance is given as:

$$z(t_p) = \frac{r_f}{tg\alpha}(f^{1/2} - 1)$$

The ionization time can be evaluated as:

$$t_{ion} = t_p\left[1 - \left(1 - \frac{1}{f}\right)^{1/2}\right]$$

where f is the dimensionless parameter that is given as:

$$f = \frac{E_{las}(t_p)}{\pi r_f^2 F_{thr}} = F_{las}/F_{thr}$$

This simple geometrical consideration is the ratio of the maximum fluence to the threshold fluence. The measured result voids in sapphire is slightly elongated that give $z_m=0.67r_f$. For silica, $z_m=0.47r_f$. The negative effect is that the ionization front motion at the laser energy well above the ionization threshold leads to a large decrease in the absorbed energy density. The maximum fluence should be known for this applied modeling.

A nozzle is a simple device comes with a throat size at convergent-divergent configuration. The throat size is chosen to choke the flow and set the mass flow rate through the restricted flow valve chamber. The valve chamber has throat volume between converging and diverging nozzle that can be determine benefit to the thrust velocity from the region of focal volume at higher heat and pressure at ultra-short pulse. The gas flow in the throat is sonic which means the Mach number is equal to one in the throat.

Downstream of the throat, the geometry diverges and the flow is isentropically expanded to a supersonic Mach number. This depends on the area of ratio of the exit to the throat. The expansion of a supersonic flow causes the static pressure and temperature to decrease from the throat to the exit. The amount of expansion also determines the exit pressure and temperature. The exit temperature determines the exit of speed of sound which determines the exit velocity. The exit velocity, pressure, and mass flow through the nozzle determine the amount of thrust produced by the nozzle. The focus volume accelerates toward the conical valve and squeeze into the throat of chamber. Then it expands into divergence chamber for compression stage.

The conservation of mass explains and describes why a supersonic flow accelerated in the divergent section of the nozzle while a subsonic flow decelerates in a divergent duct. The mass flow rate equation is given:

$$\dot{m}=\rho VA \rightarrow \text{differntiate} \rightarrow VAd\rho+\rho AdV+\rho VdA=0$$

where $\dot{m}$ is mass flow rate, ρ is the gas density, V is the gas velocity, and A is the cross-sectional flow area.

Divide by ρVA to get conservation of mass equation:

$$\frac{d\rho}{\rho}+\frac{dV}{V}+\frac{dA}{A}=0$$

Then, use the conservation of momentum equation:

$$\rho VdV=-dp$$

An isentropic flow relates to:

$$\frac{dp}{p}=\gamma\frac{d\rho}{\rho} \rightarrow dp=\gamma\frac{p}{\rho}d\rho \rightarrow dp=\gamma RTd\rho$$

where γ is the ratio of specific heats and the equation of state is given as following:

$$\frac{p}{\rho}=RT$$

where R is the gas constant and T is temperature

The expression from these equations, γRT, is the square of speed of sound, α, is given as:

$$dp=\alpha^2 d\rho$$

For the change in pressure with the momentum equation, use this equation to obtain momentum and mass:

$$\rho VdV=-(a^2)d\rho \rightarrow \frac{V}{a^2}dV=-\frac{d\rho}{\rho} \rightarrow -(M^2)\frac{dV}{V}=-\frac{d\rho}{\rho}$$

where M=V/a.

The value of $$\frac{d\rho}{\rho}$$

is substitute into the mass flow equation:

$$-(M^2)\frac{dV}{V}+\frac{dV}{V}+\frac{dA}{A}=0 \rightarrow (1-M^2)\frac{dV}{V}=-\frac{dA}{A}$$

However, this equation tells how the velocity V changes when the area chamber changes. The result depends on the Mach number M of the flow. If the flow is subsonic, then m<1 and the term multiplying the velocity change is positive ($1-M^2>0$). Then an increase in the area (dA>0) produces a negative increase (decrease) in the velocity (dV<0).

If the gas flow in the throat is subsonic, the flow downstream of the throat will decelerate and stay subsonic. If the converging section is too large and does not choke the flow in the throat, the exit velocity is very slow and doesn't produce much thrust. And if the converging section is small enough that the flow chokes in the throat, then a slight increase in area causes the flow to go supersonic. For a supersonic flow (M>1), the term multiplying velocity change is negative ($1-M^2<0$). Then an increase in the area (dA>0) produces an increase in the velocity (dV>0).

For supersonic (compressible) flows, both density and the velocity are changing as the area changed in order to conserve mass. The equation is given as:

$$-(M^2)dV/V=d\rho/\rho$$

This tells that for M>1, the change in density is much greater than the change in velocity. To conserve both mass and momentum in a supersonic flow, the velocity increases and the density decrease as the area is increased. This result concludes that the gas flow can be made into compressible core storage at greater force in oneway flow direction.

Hot plasma inside the channel is created when laser intensities have the range of $10^{12}$ W/cm$^2$<$I_L$<$10^{16}$ W/cm$^2$ at femtoseconds pulse duration. This plasma exerts a high pressure on the surrounding material (glass tube channel under boundary condition protect with or without magnetic field shield). The formation of an intense shock wave is moving into the interior of the channel which toward to target area. The momentum of the out-flowing plasma of the channel balances the momentum imparted to the compressed medium behind the shock front. It is similar to a rocket effect. The ablation pressure is dominant when laser irradiances, $I_L$, is less than $10^{16}$ W/cm$^2$. In this last case, the pondermotive force drives the shock wave. This is non-relativistic shock wave. And if apply $I_L>10^{21}$ W/cm$^2$, then it is a laser induced relativistic shock wave.

The non-relativistic or also relativistic one dimensional shock wave is described by five variable parameters. They are the particle density n or the density ρ=Mn where m is the particle mass, the pressure P, the energy density e, the shock wave velocity $u_s$ and the particle flow velocity $u_p$.

The strength of fluence depends on the ultrashort pulse duration of the laser frequency operation. Fluence is using laser pulse operation where intensity is typically or generally used for laser continued wave (CW) operation. The pulse irradiance affects either the strength of the non-relativistic or relativistic shock compressed plasmiod waves.

The capacitor model for laser irradiances, $I_L$ where the ponderomotive force controls the interaction. The parameters are $n_e$, $n_i$, $E_x$, and $\lambda_{DL}$, for the capacitor model where $n_e$ and $n_i$ are the electron and ion densities respectively, $E_x$ is the electric field, and $\lambda_{DL}$ is the distance between the positive and negative double layer -(DL) charges. The system of the negative and positive layers is called a double layer-. The neutral plasma is the electric field decays within a skin depth δ follows by DL geometrically and a shock wave is created. The shock wave is description in the position model. β is important parameter to determine the strength of piston force driven mechanism where $u_p$ and c is particle flow velocity and speed of light respectively.

When the shockwave leaves the check valve chamber, the pressure drops within the check valve chamber allowing low pressure hydrogen to refill the check valve chamber in preparation for the next laser pulse. Each subsequent laser pulse repeats the process producing a near constant flow rate of hydrogen.

Beam dumps can be used in water-cooled and air-cooled configurations with reflective mirror and require adding optical isolator for laser. The purpose of the beam dump is to create an "infinite internal trap" of laser beam energy. This beam dump device is valuable and useful for creating wake plasma mechanism.

Also, the wake plasma design is not limited to tile angle of the second laser beam to excite the first plasma. This mechanism is to accelerate the plasma further distance and greater force and pressure.

These methods are possible options, but it is preferred to use the method of the Helmholtz Coils. They are a much better way to squeeze plasma into accelerator, greater force with external plasma capacitor circuit, and a simple low cost design.

Vortex arrays induce some streamlines velocity (self-induced motion) toward compress core storage. The hydrogen and plasma are forced through the restrictive flow chamber along the complex path with each successive shockwave caused by the laser pulses into the storage chamber.

Core storage has many tunnel holes along its groove patterns. Some regions are off limits to avoid the highest pressure at areas of high stress concentration. All tunnel holes (30) are in spiral step similar to helix structure.

These designs produce large volumetric and low gravimetric capacity. In other words, the core storage produces more energy density at lower weight for compressor.

Recall that if the flow is perpendicular to the Cone Valve (CV) boundary at each inlet and outlet, cos $\theta_{VA}$ is 1 at the outlets and −1 at inlets. This is also:

$$\dot{E}_{mom} = \sum_k \left[ (\rho Q \vec{V})_{Outlets} - (\rho Q \vec{V})_{Inlets} \right]$$

If the fluid is incompressible, ρ is taken outside of the summation signs in any equations. Therefore, if the fluid is incompressible and the CV has only one inlet and outlet, then $Q_{in}=Q_{out}$.

$$\dot{E}_{mom}=\rho Q(\vec{V}_{out}-\vec{V}_{in})$$

This is still applied for core storage for gas inlet and outlet flows at perpendicular of groove patterns except for inlet and outlet of cone valve and exhaust chamber, respectively. These will lead to some momentum force loss toward the different of angle of groove patterns. The purpose of this design intention is to slow down the velocity flows and help heat maganement toward the core storage and output of the core storage.

This is an example of one sprial staircase per groove. Core storage will have many sprial staircase in every groove pattern to increase volumetric capacity and decrease the graviatmetric capacity. Also, another reason for using different angular groove pattern cores is to damp mechanical structure vibration, strengthen mechanical structure support, thermal shock, and flow control via pulsed plasma pressure at low cost design. The groove patterns guide the hydrogen flow toward the tunnels and help reduce plasma pressure.

Several manufacturer methods can produce small and large glass hole core storage parts. One of these options is laser drilling holes. A microdrilling with diameter in the range of less than 50 μm can be performed with high aspect ratio by UV laser ablation in glass as well as in other materials. Other groups have done this in many attempts using laser drilling to achieve high aspect 600 to 1. The end of drilling is characterized by stationary hole profile which can be detected by the limit hole depth l. This depth l is expressed as a function of the fluence F incident on the glass by:

$$Hl(F) = z_0\left[\left[1 + 2\left(\frac{F}{F_\infty}\right)\left(\frac{r_0}{z_0}\right)\right]^{1/2} - 1\right]$$

where $r_0$, $z_0$, and $F_\infty$ are respectively the hole radius, the distance of the focal point to target surface and the fluence threshold for material removal.

The depth glass for UV laser drilling can go up to 18 mm (0.71 inches) of deep holes. The benefit of using this UV Laser drilling on glass is that the process does not depend on the hardness or electrical conductivity of the material, is capable of producing smaller holes at angles of up to 80 degrees from the perpendicular and higher aspect ratio holes, does not subject the material to mechanical stress, the processing time is short for hundreds or even thousands holes, and the laser beam cannot break like a drill and ruin the part.

This useful tool provides a greater opportunity to manufacture small preformed glass core storage effectively that can be assembled in arrays for the cascade compressor storage system. Eventually, an advanced technology machine tool will enable manufacturers to produce larger core storage parts using laser drilling methods. Existing machining tools are able to create any shape and groove dielectric materials (glass) parts via molding, laser cut and drilling machining (3 to 9 axis), and hybrid laser with hydrofluoric acid bath and ultrasonic (etched away).

The concept of an exhaust cone design helps to produce more laminar flow smoothly and quickly for exhaust output of gas connector. Also, the exhaust cone is used to more effectively refill and dispense hydrogen gas. The exhaust gas from the groove pattern of the core storage will enable rotation toward the exhaust cone output.

The Reynolds number indicates the relative significance of the viscous effect compared to the inertia effect. It is a useful and important tool in analyzing any type of flow when there is substantial velocity gradient (shear). The Reynolds number is proportional to inertial force divided by viscous force. The flow is laminar when Re<2300, transient when 2300<Re<4000, and turbulent when 4000<Re.

FIG. 1 shows the compressor (100), which is connected in series with a low pressure hydrogen source and higher pressure load in an open or closed system. The compressor is cylindrical. The hydrogen source is in fluid communication with the compressor though an inlet (1) in the aft end. The inlet can be in line with the center axis of the compressor or at an angle to the axis, depending on the system in which the compressor is installed. A flow path for gas is present for the entirety of the compressor interior, from the check valve chamber (2), past a nozzle and diffuser assembly (3), through a restrictive flow valve chamber (4), into a storage chamber (5), to an exhaust valve (6); pressure will be equalized throughout, priming the compressor for operation. Any gas left over inside the device should be evacuated, flushed out or degassed before charging new gas. The check valve (2) is located at the upstream end of the compressor housing the stack conical structure (16). Downstream of the check valve chamber (2) is the restricted flow chamber (4) housing a cone insert (25). Downstream of the restricted flow chamber (4) is the storage chamber (5), with a shell (33), a spiral core (28), and spiral grooves (39). Downstream of the storage chamber (5) is the exhaust (6), housing an exhaust guide (29), and connected to an adapter (7).

Figure 2:
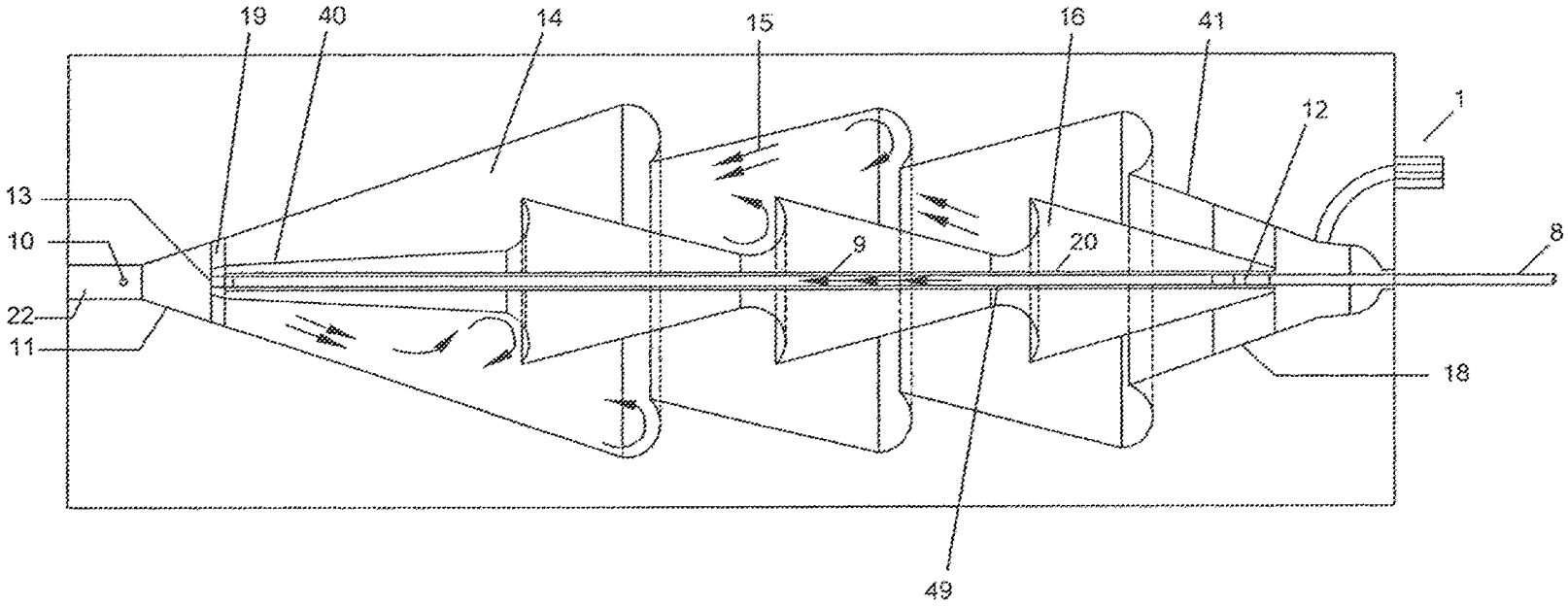
FIG. 2. Depicts an embodiment of the check valve chamber.

FIG. 2 Depicts an embodiment of the check valve chamber, in which the hydrogen inlet (1) is at an angle to the compressor axis and a femtosecond laser (8) is in line with the compressor center axis. A laser pulse (9) from the femtosecond laser (8) has an intended focal point (10) within a nozzle (11) portion of the check valve. A tube runs the center of the structure providing a path for the laser. The laser beam bore tube (20) consists of a long hollow cylinder or rectangle that allows any fiber or optical lens components to be installed inside. These optical components can be fiber optic lines, mirrors, lenses, or a mixture of the three.

The lenses (12) may be designed to allow transmission of specific wavelengths. The lenses may also be a Bragg Grating used to expand the beam and lower its intensity to prevent damage the focusing lenses (13). The laser may be a single beam or an array of beams. A focusing lens (13) installed in the laser bore tube (20) focuses the single beam or the array of on to the single focal point (10).

The check valve cavity (14) is designed as a series of cavities that start with a large cross section and then taper to a small cross section in the direction of the flow of low pressure hydrogen (15). The widest cross section of each of these cavities has a circular lip, which connects the cavity to the narrow cross section of the following cavity. Housed within each cavity, is a structure of a small cross section which expands to a large cross section within the adjoining cavity. The base of the structure is a concave circular lip that connect to the small cross section of the following structure. This stacked conical structure (16) combined with check valve cavity produces a low resistance to flow in the direction of the low pressure hydrogen flow and a large resistance to back flow (17). A tapered cylindrical extension (40) extends from the base of the stacked conical structure (16) to the nozzle upstream of the focal point. The stacked conical structure (16) is held in place by forward (18) and aft (19) finned support structures. The forward support structure (18) is in physical contact with the first cone in of the stacked conical structure (16) and is in physical contact with the first of the series of inner conical surfaces (41) of the check valve cavity. The aft finned support structure (19) is in physical contact with the end of the tapered cylindrical extension (40) and is in physical contact with the last of the series of inner conical surfaces (41) of the check valve cavity.

Vortices (21) produced by the design of the check valve resist backflow (17) leaving only the nozzle (11) as an outlet for increased pressure created by a laser induce plasma shockwave. A small capillary (22) extends from the nozzle to a diffuser in the restricted flow chamber (4).

Figure 3C:
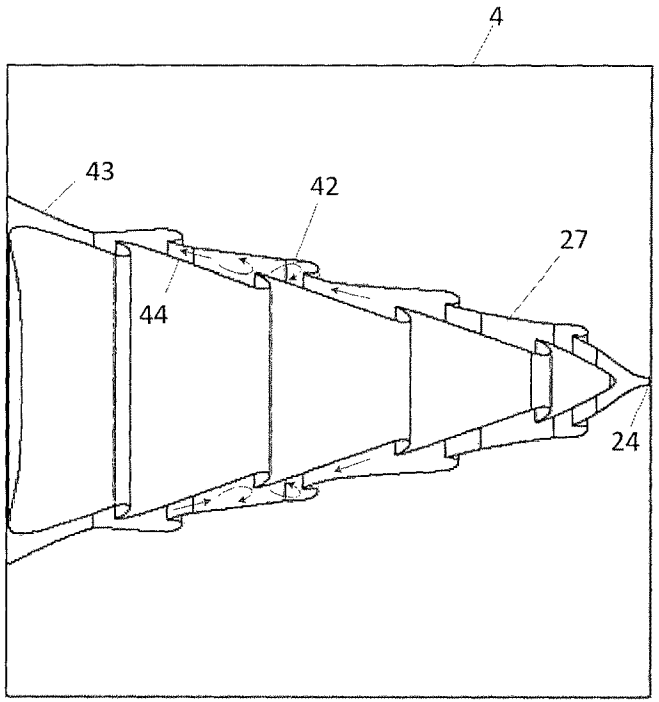
FIG. 3C. Depicts the assembled restricted flow chamber and the resulting flow path.
Figure 3B:
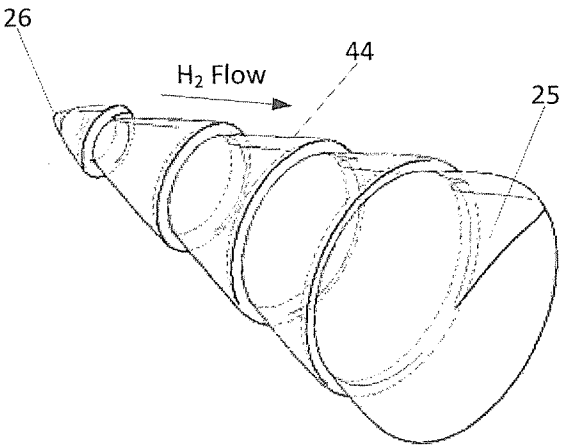
FIG. 3B. Depicts the restricted flow chamber insert.
Figure 3A:
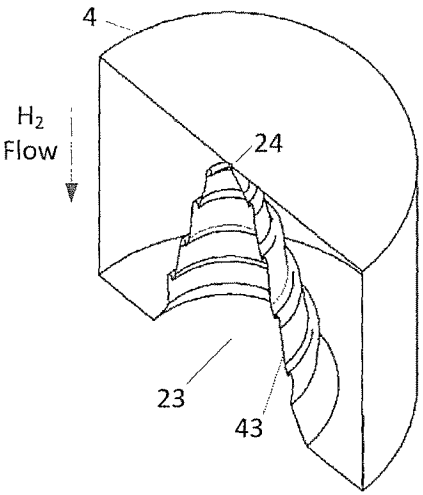
FIG. 3A. Depicts an axial Cross section of the restricted flow chamber shell.

FIGS. 3A, 3B, and 3C depicts the components and the flow path of the restricted flow chamber.

FIG. 3A is a cross section of the restricted flow chamber (4). The restricted flow chamber consists of a cavity (23) from a small cross section connected to the diffuser (24) to a large cross section connecter to the storage chamber. The cavity is made up of a series of substantially cylindrical cavities of increasing size stacked end to end. At the leading edge of each cylindrical cavity is a "S" shaped ring that connects the leading edge of one cavity to the trailing edge of the cavity prior to it.

FIG. 3B is a cone insert (25), with a tip (26) of which can reflect the shock front waves and also absorb laser beam target leftover acting as a laser beam dump. The tip (26) can be designed with a magnetic field assembly and fused with glass-ceramic material, for resistance to plasma flow. The cone insert (25) is made up of a plurality of cones of increasing diameter stacked base to tip. The base of each cone is a concave lip connecting the base to the tip of the following cone. The cone insert (25) is primarily made of glass or ceramic materials.

FIG. 3C show the placement of the cone insert (25) within the cavity (23). A complex flow path (27) is created by the inner stepped conical surface (43) of the restricted flow chamber (4) and the outer stepped conical surface (44) of the cone insert (25). A powerful vortex array (42) resists any backward pressure flows from the higher pressure storage chamber.

Figure 4A:
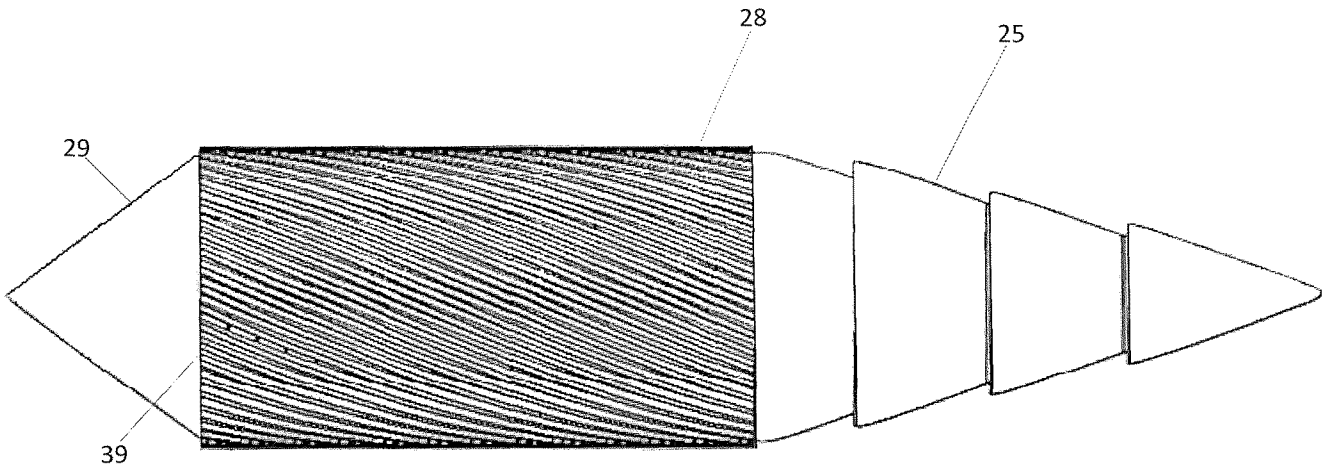
FIG. 4A. Depicts the spiral groove embodiment of the storage module core.

FIG. 4A shows the spiral grooved core (28) of the storage chamber (5). The spiral grooved core (28) is fused at one end to the cone insert (25), and at the other end to a substantially conical exhaust guide (29). The spiral grooved core (28) consists of a solid cylinder with plurality of grooves (39) surrounding its outer surface arranged in a substantially 90 degree arc. Though the arc of the spiral pattern is shown to be 90 degree, can arc design can be modified to meet the needs of the system. The storage chamber (5) groove pattern can be spiral or helix, and even straight grooves (39).

Figure 4C:
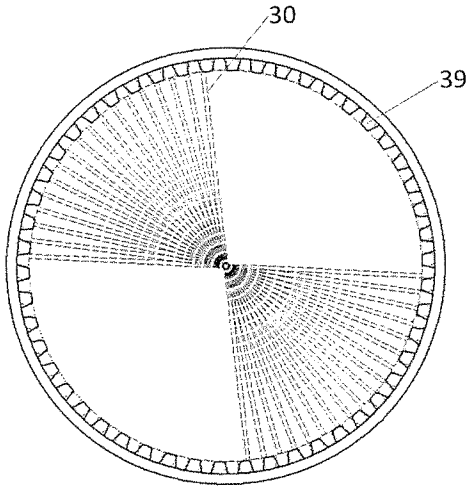
FIG. 4C. Depicts the helical pattern of the tunnels for spiral storage module core.
Figure 4B:
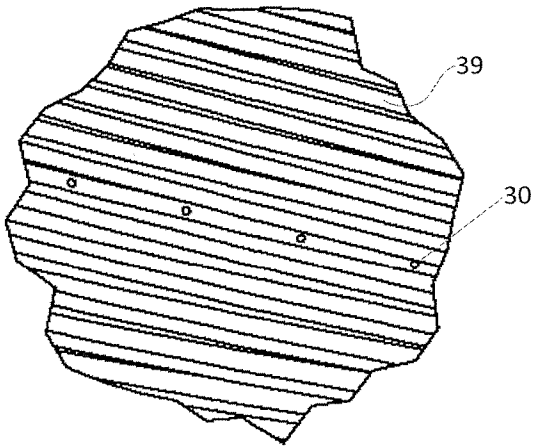
FIG. 4B. Depicts the tunnel alignment of the spiral storage module core.

FIGS. 4B and 4C show the tunnel pattern within the spiral grooved core (28), which has a plurality of tunnel holes (30) or small bore orifices. The diameter of the tunnel hole (30) will be no wider than the groove in which it resides. The tunnel holes will extend straight from one grove to a second groove opposite of the first. Other grooves (39) may not have tunnels to insure the tunnels may not interact with each other. The tunnels holes (30) in the spiral grooved core (28) are in the pattern of a spiral staircase. The spiral grooved core (28) is not limited to the use of tunnel holes, it may also use small bore orifices which do not extend to the center of the core. Allowing for a greater volume while still ensuring no interaction between the tunnel holes and orifices.

Figure 5B:
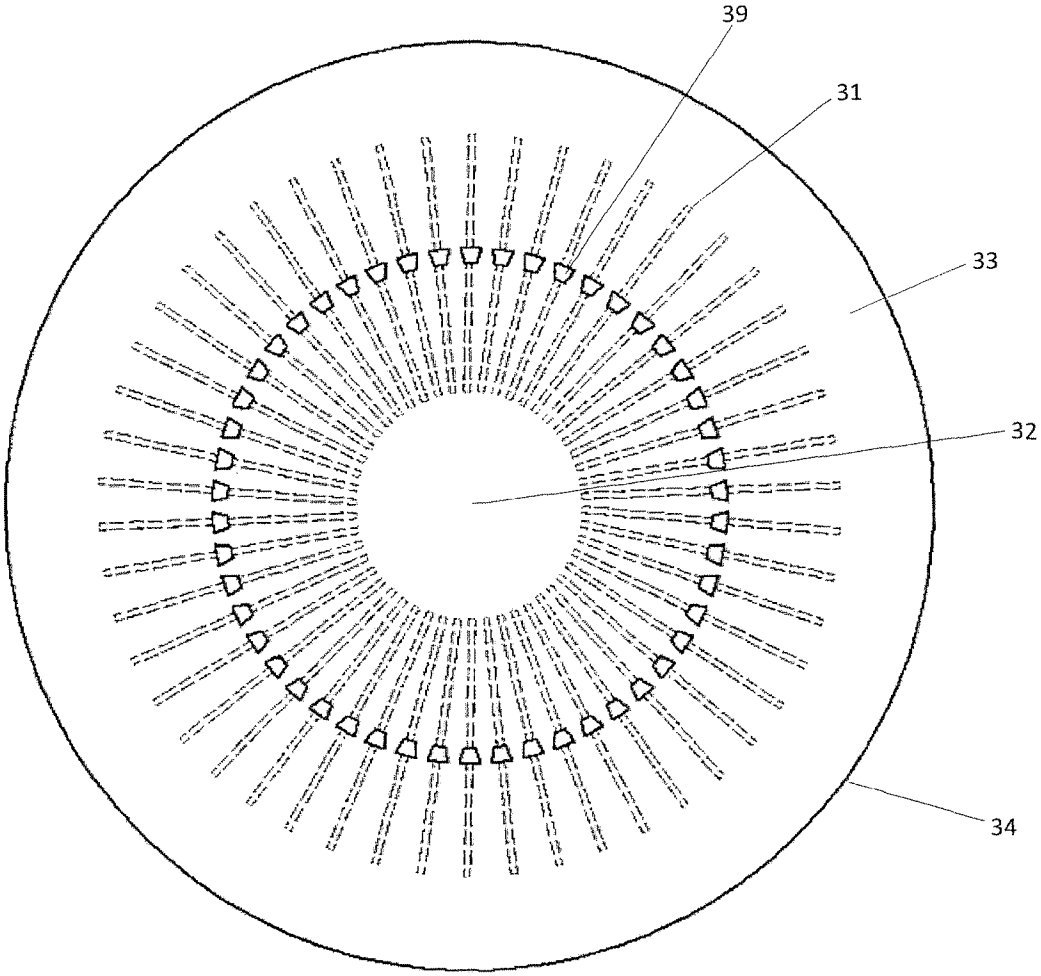
FIG. 5B. Depicts a side view of the straight groove storage module.
Figure 5A:
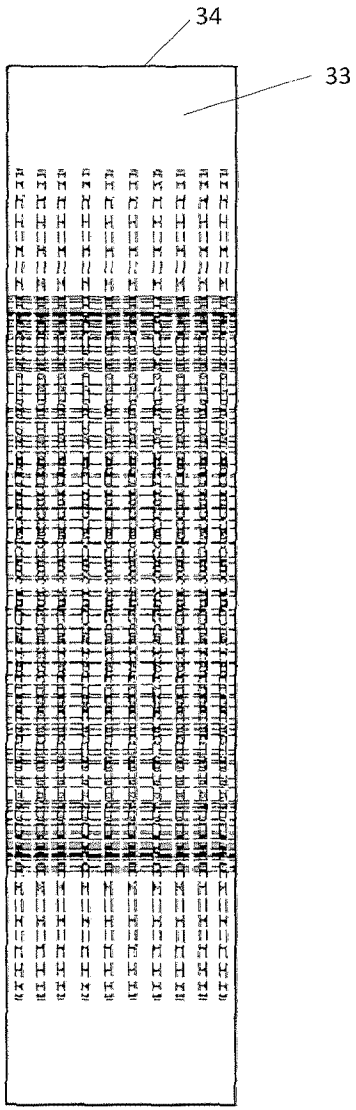
FIG. 5A. Depicts the straight groove embodiment of the storage module core and shell.

FIGS. 5A and 5B show the straight groove embodiment of the storage chamber (4). The straight groove core (32) is fused on one end to the cone insert (25) and to the conical exhaust guide (29) on the other end. The straight groove core (32) consist of a solid cylinder with a plurality groove running straight from the cone insert (25) to the conical exhaust guide (29). Each of the grooves contain a plurality of small bore orifices (31) which extend into the straight groove core (32) without reaching the center. The storage chamber shell (33) may contain a plurality of small bore orifices (31) that correspond with an opposite small bore orifice, when used with the straight grooved core (32), or contained when designed for use with the spiral grooved core (28). The small bore orifices (31) in storage chamber shell extend into the shell, nearing but not reaching the storage shell outer surface (34). The cylinder grooved core (28) and the straight grooved core (32) both act heat sinks while the storage chamber shell (33) acts as a heat exchanger.

Figure 6B:
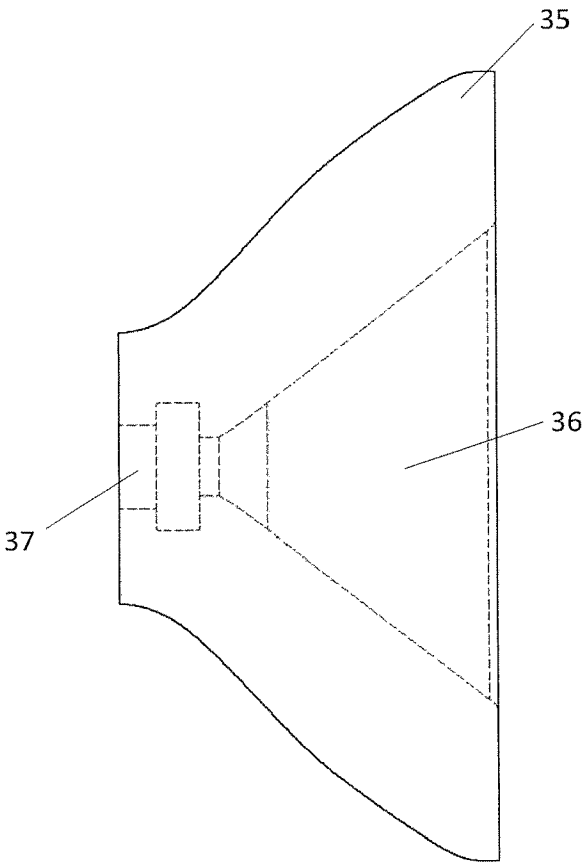
FIG. 6B. Depicts a side view of the exhaust shell.
Figure 6A:
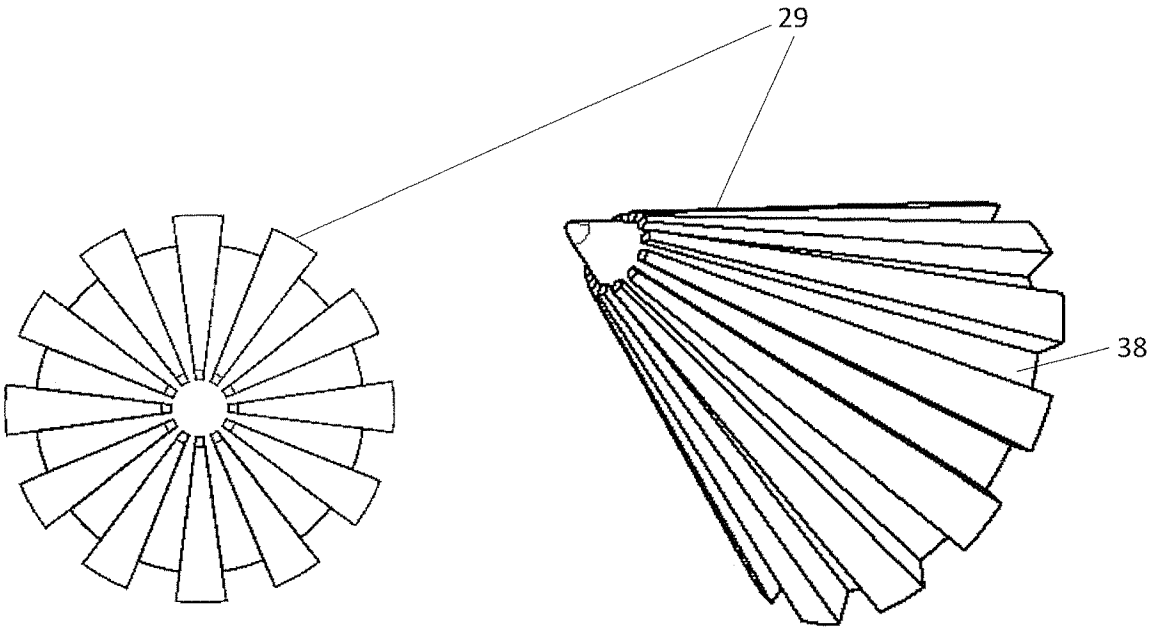
FIG. 6A. Depicts an embodiment of the exhaust cone.

FIG. 6A shows an embodiment of the conical exhaust guide (29), while FIG. 6B shows the exhaust shell (35). The exhaust (6) consists of an exhaust shell (35) with a conical cavity (36), which houses the conical exhaust guide (29). Connected to the conical cavity (36), is a complex shaped cavity (37) designed to house the adapter (7), which connects the compressor (100) to the open or closed system in which the compressor is installed.

The grooved embodiment of the conical exhaust guide depicted in FIG. 6A can be used with either the straight grooved core (28) or the spiral grooved core (33). The grooves (38) may align with the grooves in the storage chamber (5) and provide improved structural integrity to the exhaust (6). The exhaust shell (35) and conical exhaust guide (29) form a smooth path through the adapter (7) to an open or closed system. Internal, pressure, density and flow rate are controlled by a regulating in the open or closed system based on the need of the system.

Figure 7:
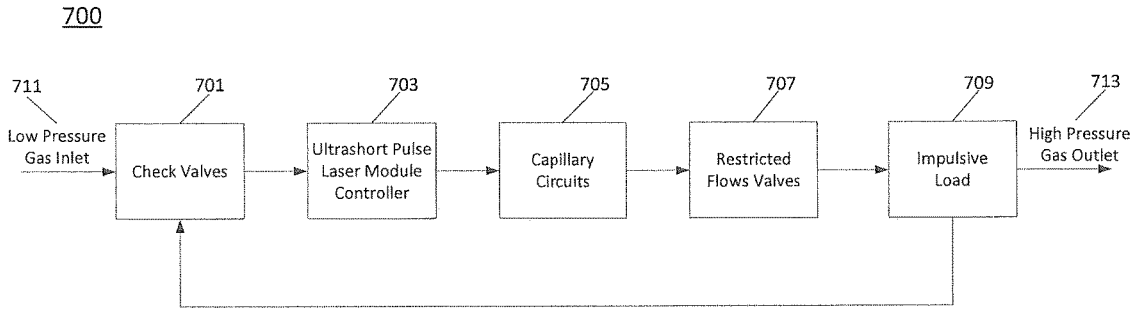
FIG. 7. Depicts a simple flow diagram for the method of shock gas compression using Laser Driven Mechanism FIG. 8. Depicts a detailed flow diagram of the method of shock gas compression using a Laser Driven Mechanism While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.
Figure 8:
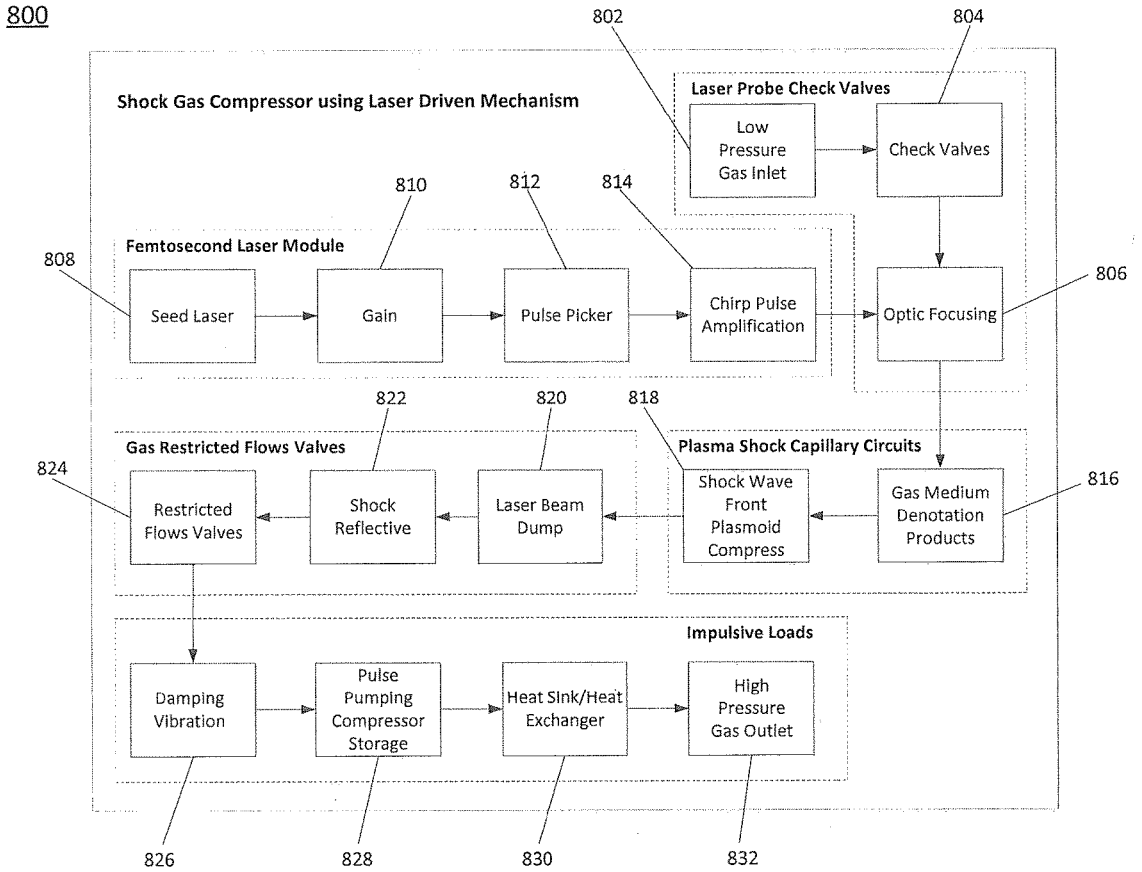

FIG. 7 shows the basic method (700) of the compressor in a closed circuit, such as a hydrogen based refrigeration unit. The path being the low pressure gas inlet (711), when charging the system. Followed by the check valves (701), then the Ultrashort Pulse Laser Module Controller (703), which sends the laser pulse, capillary circuits (705) direct the plasma and gas to the restricted flow valve (707). The restrictive flow valve (707) prepares the hydrogen for the impulsive load (709). The impulsive load being the storage unit and any other loads or heat exchangers that use the hydrogen before it is returned to the check valves. Lastly the High Pressure Gas Outlet (713) is used to remove hydrogen from the system FIG. 8 show a detailed method (800) of the shock compression using a Laser driven mechanism. The Low Pressure Gas Inlet (802) allows the flow of gas into the check valves (804), which resist back flow and direct hydrogen to the optical focusing (806) point. A femtosecond mode-locked laser gain (810) (boost energy of laser irradiance), which may consist of saturable absorber optics, tuning mirror, doping fiber, can be used and work with a seed femtosecond laser module (808) (lower energy), which may consist of a high power current supply, a solid state laser diode, and a laser oscillator crystal. The purpose of the pulse picker (812) is to create desired pulse trains using femtosecond duration at pulse frequency generator rate. The pulse picker is controlled by a high voltage power supply, a pulse frequency generator, and a pulse picker crystal (e.g. band pass or notch filter). The pulse picker is used to selectively pick off pulses from the pulse train of a femtosecond laser. The purpose of the chirp pulse amplification (812), consisting of a pulse stretcher, doping amplifier fiber, and pulse compression optics, is to meet threshold damage of fiber or optical components for long lifetime and safety operation. The laser pulse through optical focusing (806) to a single point. It interacts with the hydrogen producing gas medium detonation products (816) in the form of plasma and a shockwave front. The shock wave front (818) forces the plasma and hydrogen. The stepped cone in the restricted flow valves (824) absorbs excess laser acting as a laser beam dump (820) and reflects some of the shockwave (822) directing the rest to the restricted flow valves (824). Vibration damping (826) occurs within the storage module. Each laser pulse pumps more hydrogen into the compressor storage (828) raising pressure. The small bore orifices (31) provide a volume in which the plasma recombines and the hydrogen gas is compressed. Excess heat is removed from the hydrogen (830) via the core acting as a heat sink and the shell transferring heat out of the compressor. This can be achieved through the storage shell outer surface (34) by jacketing with a coolant or installing fins to improve heat transfer. Graphite or metal inserts may also be used in the chamber to improve heat removal from the gas. When desired pressure and temperature is achieved hydrogen is released to the system via the high pressure gas outlet (832) as system demands dictate.

Though the disclosed subject matter is described specifically with respect to compressing hydrogen, it can be used to compress any gas including air, requiring only modifications in wave length and pulse frequency and structural dimensions, with little change in fundamental design. This disclosed subject matter can also be used to pump gasses and fluids, such as water without compression, as a plasma accelerator through use of Helmholtz coils and plasma capacitor circuits. The disclosed subject matter can be used as an ultrafast switching dynamic polarization controller, using a plasma capacitor tube circuit. The principle of this disclosed subject matter can also be used to generate hydrogen through laser driven water thermolysis. The disclosed subject matter can be made with a 3 dimensional flow path described above, or made with a 2 dimensional flow path. For a 2 dimensional flow path the cones are replaced with wedges, the cylinders with rectangular plates, and the storage core will have paths normal to direction of flow leading from the outer edges of the core toward but not reaching the centerline of the core. A 2 dimensional flow path will not require the finned supports nor will is require the restricted flow chamber and exhaust wedges to be fused to the storage core. The laser pulse (9) of FIG. 2 can be an array of pulses created be the lens (12). The lens (13) can be an array of lenses directing the array of pulses to a single focal point. The forward finned support structure (18) of FIG. 2 can be configured to receive a laser pulse normal to the compressor center axis, and reflect it via mirror along the center axis.

Figure 2A:
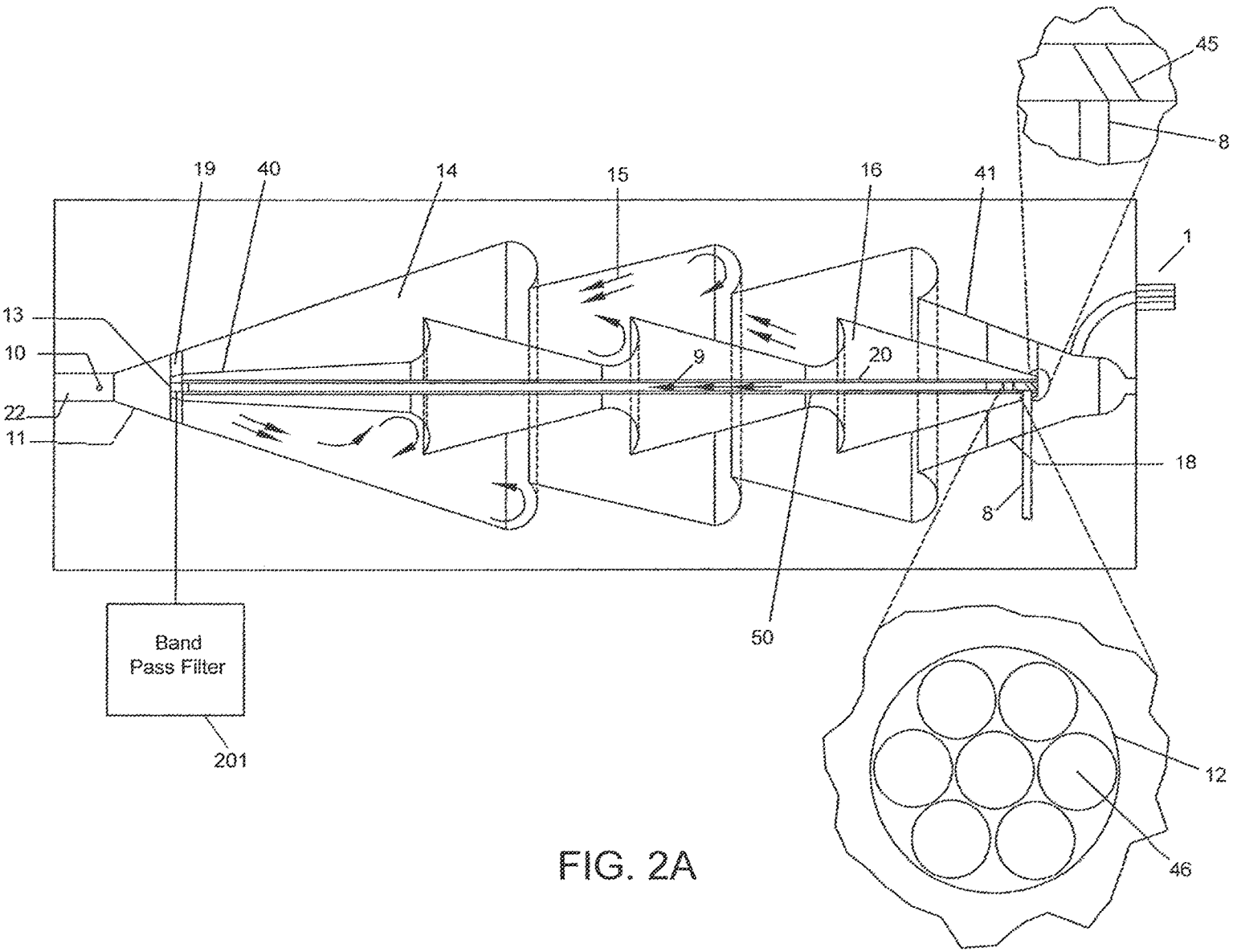
FIG. 2A. Depicts an embodiment of the first check valve.
Figure 2B:
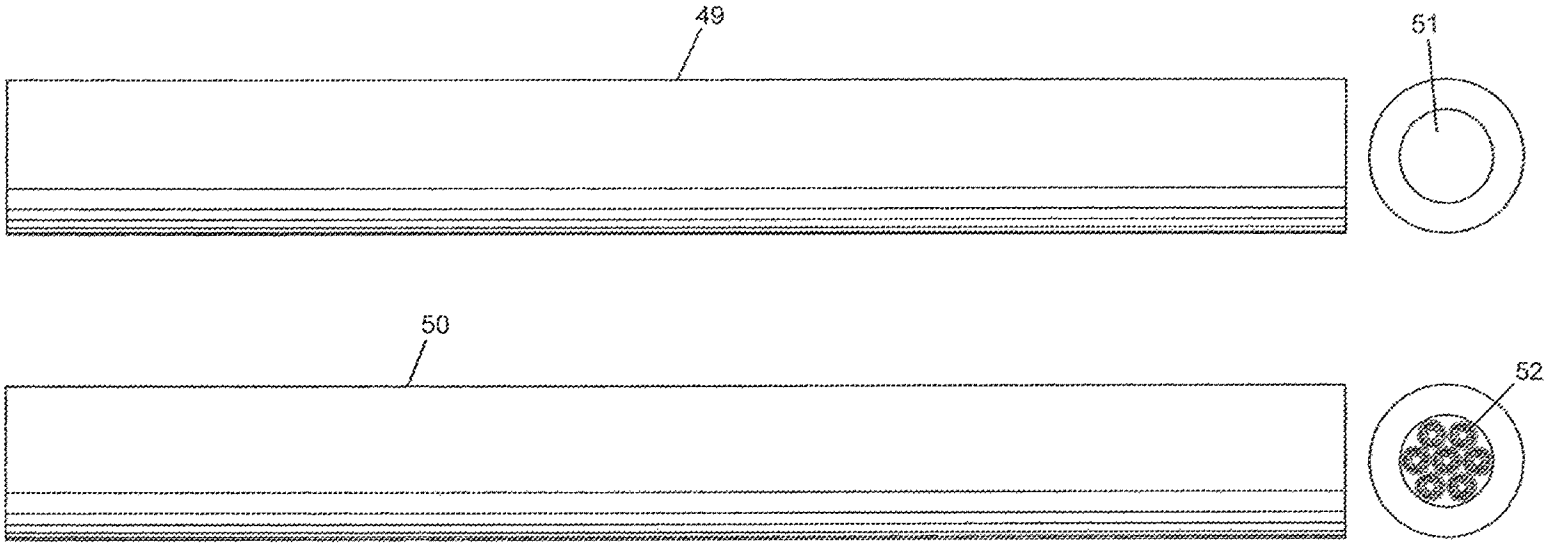
FIG. 2B. Depicts an embodiment of the fiber optic line.

Various optional components can produce multiple embodiments of the plasma shock compressor. Fiber optic line 49 shown in FIG. 2 and FIG. 2*b* can be used to direct the laser pulse 9 to focusing lens 13 while protecting the inner wall of laser beam bore tube 20. The fiber optic line 49 may be made up of a single path 51 or may bundle 50 a plurality of fiber optic lines 52. FIG. 2*a* shows femtosecond laser 8 may be configured to enter the first check valve normal to the compressor center axis. A mirror 45 may redirect the laser pulse into an embodiment of lens 12. Lens 12 may be made up of a plurality of smaller lenses 46 to split the laser beam into multiple beams. Lens 12 will direct the beam to fiber optic line bundle 50. Fiber optic line bundle 50 will direct the pulse 9 to focusing lens 13 which may act as a band pass filter 201. Although depicted with fiber optics lines installed in bore tube 20, may with or without fiber optic lines installed. Bore tube 20 at a vacuum or may be filled with a different gas and sealed off by lenses 12 and 13.

The examples set forth above are provided to give those of ordinary skill in the art a complete disclosure and description of the acoustic lens system and methods to control and/or redirect acoustic waves or pulses in the present disclosure, and are not intended to limit the scope of what the inventors regard as their disclosure. Modifications of the above-described modes for carrying out the disclosure may be used by persons of skill in the art, and are intended to be within the scope of the following claims. All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims. The foregoing Detailed Description of exemplary and preferred embodiments is presented for purposes of illustration and disclosure in accordance with the requirements of the law. It is not intended to be exhaustive nor to limit the disclosed subject matter to the precise form or forms described, but only to enable others skilled in the art to understand how the disclosed subject matter may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom.

This disclosure has been made with respect to the current state of the art, but also contemplates advancements and that adaptations in the future may take into consideration of those advancements, namely in accordance with the then current state of the art. It is intended that the scope of the disclosed subject matter be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims.

What I claim is:

1. A gas compressor comprising:

a gas;

a gas inlet;

a compressed gas outlet;

a gas passage between the gas inlet and the compressed gas outlet, the gas passage comprising:

a first check valve biased against flow towards the gas inlet;

a nozzle downstream from a first portion;

a diffuser;

a capillary connecting the nozzle and diffuser and having a focal point located within; and, a restrictive flow valve chamber biased against flow towards the gas inlet and located between the diffuser and the compressed gas outlet;

a storage chamber downstream of the restrictive flow valve chamber; and, a pulsed laser configured to direct a beam upon the focal point, wherein the storage chamber comprises a core surrounded by an outer shell in thermal communication with a heat sink.

2. The compressor of claim 1, wherein the gas is hydrogen.

3. The compressor of claim 1, wherein at least one of the first check valve and the restrictive flow valve chamber comprise a plurality of successive triangular chambers.

4. The compressor of claim 3, wherein at least one of the first check valve and the restrictive flow valve chamber comprise a portion of the gas passage defined between an inner conical surface and an outer conical surface.

5. The compressor of claim 3, wherein at least one of the first check valve and the restrictive flow valve chamber comprise a portion of the gas passage having a constant thickness.

6. The compressor of claim 1, wherein the first check valve and the restrictive flow valve chamber, the nozzle, the capillary, and the diffuser are concentric with a central axis.

7. The compressor of claim 1, wherein the pulsed laser is directed with one or more elements from the group comprising fiber optics, mirrors and lenses.

8. The compressor of claim 7, wherein the pulsed laser comprises a plurality of laser beams directed upon the focal point.

9. The compressor of claim 1, wherein the core further defines a plurality of grooves which interface with the outer shell to form a third portion of the gas passage.

10. The compressor of claim 9, wherein the core further defines a plurality of tunnels through the core connecting with the plurality of grooves, the plurality of tunnels are in fluid communication with the plurality of grooves.

11. A method for compressing gas comprising:

providing a gas at a first pressure at a focus area in a capillary downstream of a nozzle downstream of a first set of check valves and the capillary upstream of a diffuser;

pulsing a laser beam on the focus area;

transforming the gas at the focus area into plasma;

forming a shock wave;

restricting upstream flow of the gas by the first set of check valves;

advancing the shock wave downstream through a restrictive flow valve chamber downstream of the diffuser;

pumping the gas through the restrictive flow valve chamber via a pressure gradient caused by the shock wave;

restricting upstream flow of the gas with the restrictive flow valve chamber; and, accumulating the gas and the plasma in a storage chamber downstream from the restrictive flow valve chamber and transferring heat away from the storage chamber;

wherein the first set of check valves, the nozzle, the diffuser, the restrictive flow valve chamber and the storage chamber are in fluid communication.

12. The method of claim 11, further comprising filtering out undesired laser beam wavelengths prior to the focus area.

13. The method of claim 11, wherein the step of pulsing the laser beam on the focus area comprises focusing a plurality of laser beams upon the focus area.

14. The method of claim 11, wherein the step of pulsing the laser beam on the focus area comprises directing the laser beam on the focus area by one or more of the group consisting of mirrors, lenses, and fiber optics.

15. The method of claim 11, wherein the first pressure is lower than an inlet pressure and the storage chamber pressure is greater than the inlet pressure.

16. The method of claim 11, wherein the step of restricting upstream flow of the gas comprises generating vortices within each of the first set of check valves and the restrictive flow valve chamber.

17. The method of claim 11, wherein the step of forming a shock wave comprises rapidly expanding the gas and the plasma.

18. A hydrogen gas compressor a gas inlet;

a compressed gas outlet;

gas passage between the gas inlet and the compressed gas outlet, the gas passage comprising:

a first check valve biased against flow towards the inlet; the first check valve comprising a first portion of the gas passage defined by a series of inner conical surfaces and a series of outer conical surfaces;

a nozzle downstream from the first portion of the gas passage and connected to a diffuser by a capillary having a focal point located within, and the nozzle, the capillary and the diffuser being concentric with the conical surfaces of the first check valve;

a restrictive flow valve chamber biased against flow towards the inlet and located between the diffuser and the gas outlet; the restrictive flow valve chamber comprising a second portion of the gas passage defined by a second inner stepped conical surface and a second outer stepped conical surface;

wherein the steps of the second inner stepped conical surface and the second outer stepped conical surfaces are axially offset from one another;

a compressed hydrogen gas storage chamber comprising a core with a plurality of grooves surrounded by an outer shell and a plurality of tunnels defined through the core interconnecting ones of the plurality of tunnels; a femtosecond laser configured to direct a beam upon the focal point; and a band pass filter positioned between the laser and the focal point; wherein the first check valve further defines an optical passage from the femtosecond laser to the focal point.

* * * * *